US011185906B2

(12) United States Patent
Ma et al.

(10) Patent No.: US 11,185,906 B2
(45) Date of Patent: Nov. 30, 2021

(54) TOOL WITH HEATER FOR FORMING PART WITH TAILORED PROPERTIES

(71) Applicant: MAGNA INTERNATIONAL INC., Aurora (CA)

(72) Inventors: Yunxin Ma, Oakville (CA); David Polsoni, Woodbridge (CA)

(73) Assignee: MAGNA INIERNATIONAL INC., Aurora (CA)

( * ) Notice: Subject to any disclaimer, the term of this patent is extended or adjusted under 35 U.S.C. 154(b) by 324 days.

(21) Appl. No.: 16/474,872

(22) PCT Filed: Aug. 30, 2017

(86) PCT No.: PCT/CA2017/051017
§ 371 (c)(1),
(2) Date: Jun. 28, 2019

(87) PCT Pub. No.: WO2018/039789
PCT Pub. Date: Mar. 8, 2018

(65) Prior Publication Data

US 2019/0366408 A1 Dec. 5, 2019

Related U.S. Application Data

(60) Provisional application No. 62/381,551, filed on Aug. 30, 2016.

(51) Int. Cl.
*B21D 22/20* (2006.01)
*B21D 22/02* (2006.01)
(Continued)

(52) U.S. Cl.
CPC ..... *B21D 22/208* (2013.01); *B21D 22/022* (2013.01); *B21D 22/06* (2013.01);
(Continued)

(58) Field of Classification Search
CPC .... B21D 22/208; B21D 22/022; B21D 22/06; B21D 37/16; B21D 53/88; B21J 1/06;
(Continued)

(56) References Cited

U.S. PATENT DOCUMENTS 3,926,029 A * 12/1975 Abson ..... B21J 13/02 72/342.92
7,159,437 B2 * 1/2007 Schroth ..... B21D 37/16 72/342.8
(Continued)

FOREIGN PATENT DOCUMENTS

DE 102009043926 A1 3/2011
DE 102011018850 A1 10/2012
(Continued)

OTHER PUBLICATIONS

Translation of DE-102011018850-B4 (Year: 2015).*
(Continued)

*Primary Examiner* — Adam J Eiseman
*Assistant Examiner* — Teresa A Guthrie
(74) *Attorney, Agent, or Firm* — Pillsbury Winthrop Shaw Pittman LLP

(57) ABSTRACT

Disclosed is a forming system having a first die assembly and a second die assembly with dies having die surfaces that are configured to cooperate with each other to form a die cavity therebetween so as to receive a workpiece therein. One or both of the dies includes a heater insert member that has a serpentine groove therein for receiving a flexible heater member. The flexible heater member is configured to conform with the shape of the serpentine groove. The heater insert member is position adjacent to the die surface and provides more uniform heating of the surface to form complex 3D surfaces with tailored properties.

24 Claims, 19 Drawing Sheets

(51) Int. Cl.

| | |
|---|---|
| ***B21D 22/06*** | (2006.01) |
| ***B21D 37/16*** | (2006.01) |
| ***B21D 53/88*** | (2006.01) |
| ***B21J 1/06*** | (2006.01) |
| ***B21J 13/02*** | (2006.01) |

(52) U.S. Cl.
CPC ..... *B21D 37/16* (2013.01); *B21D 53/88* (2013.01); *B21J 1/06* (2013.01); *B21J 13/02* (2013.01)

(58) Field of Classification Search
CPC ..... B21J 13/02; C21D 1/673; C21D 1/40; B29C 51/42; B29C 51/428
USPC ..... 72/38, 342.7–342.92
See application file for complete search history.

(56) References Cited

U.S. PATENT DOCUMENTS

| | | | | |
|---|---|---|---|---|
| 8,261,592 | B2 | 9/2012 | Mehta et al. | |
| 2004/0069039 | A1* | 4/2004 | Hammar | B21D 26/055 72/342.7 |
| 2006/0230806 | A1 | 10/2006 | Bohner | |
| 2014/0260493 | A1* | 9/2014 | Yoon | B21D 37/16 72/342.5 |
| 2016/0175910 | A1* | 6/2016 | Luetkemeyer | B30B 15/064 72/352 |

FOREIGN PATENT DOCUMENTS

| | | | | |
|---|---|---|---|---|
| DE | 102011018850 | B4 * | 6/2015 | B21D 37/04 |
| EP | 2548670 | A1 | 1/2013 | |
| EP | 2907881 | A2 | 8/2015 | |

OTHER PUBLICATIONS

International Search Report and Written Opinion issued in corresponding International Patent Application No. PCT/CA2017/051017, dated Nov. 30, 2017.
International Preliminary Reporton Patentability issued in corresponding International Patent Application No. PCT/CA2017/051017, dated Mar. 14, 2019.
Office Action issued in corresponding Chinese Application No. 201780053488.6 dated Mar. 16, 2020, with English translation (22 pages).
European Search Opinion and Supplemental European Search Report issued in corresponding European Application No. 17844741.3 dated Mar. 3, 2020 (7 pages).

* cited by examiner

TOOL WITH HEATER FOR FORMING PART WITH TAILORED PROPERTIES

CROSS-REFERENCE TO RELATED APPLICATIONS

This patent application is the U.S. National Phase of PCT/CA2017/051017, filed Aug. 30, 2017, which claims priority to U.S. provisional patent application 62/381,551, filed on Aug. 30, 2016. The subject matter of each is incorporated herein by reference in its entirety.

BACKGROUND

Field

The present disclosure is generally related to a hot forming system for producing vehicle parts.

Description of Related Art

Vehicle manufacturers strive to provide vehicles that are increasingly stronger, lighter and less expensive. One process used to form vehicle body parts is a hot-forming method in which heated blanks of steel are stamped and simultaneously quenched (for rapid cooling and hardening) in a hot forming die. A pre-heated sheet stock may be typically introduced into a hot forming die, formed to a desired shape and quenched subsequent to the forming operation while in the die to thereby produce a heat treated component. The known hot forming dies for performing the simultaneous stamping and quenching steps typically employ water cooling passages (for circulating cooling water through the hot forming die) that are formed in a conventional manner. In some applications, it may be desirable to cool certain portions of the stamped metal at a slower rate than other portions. Such portions of the stamped part are heated by the stamping die so that the rate of cooling is slowed substantially relative to the portions of the part that are exposed to portions of the die that received cooling fluid. The more slowly cooled portions of the part will remain softer (more ductile) than the portions of the part subject to rapid cooling (quenching). To heat portions of the die, a large number of cartridge heaters can be provided within a form block of the die so that heat is applied to areas of a product being stamped.

Although using such conventional cartridge heaters may provide good heating effect for straight and simple 3D surfaces, it is very difficult to maintain a consistent distance and thus heating efficiency of the part regions that are to be made more ductile when forming complex 3D surfaces such as automobile B-Pillars and A-Pillars.

Several different devices and methods have been employed to provide heat to specific regions of a part during forming. Some devices provide a variety of linear cartridge heaters within die parts to locally apply heat to a workpiece during its formation to form the above described complex parts. However, use of these linear cartridges in a die part can result in temperature variations along the die surface, thereby causing uneven heat distribution while forming the workpiece and thus producing an inferior product. Also, inserting numerous linear cartridge heaters into a die or stamping part has high costs associated therewith, particularly with regards to machining the tools, assembling the tools, as well as maintenance of said tools. Linear cartridge heaters are difficult to install and can break when pulled out of the die. They also require a special cleaning procedure when cartridges are replaced, further contributing to costs associated with time and money.

This disclosure provides improvements to dies used in hot forming systems and hot forming operations, and, in particular, to dies or stamps used to form complex 3D parts.

SUMMARY

In accordance with an aspect of the invention there is provided a forming system comprising: a first die assembly having a first die body and a first die surface; a second die assembly having a second die body and a second die surface; the first die surface and the second die surface having varying cross sections and configured to cooperate with each other to form a die cavity therebetween so as to receive a workpiece therein, a first heater insert member configured to be received in one of the first die body and the second die body, the first heater insert member having a first serpentine groove therein, and a first flexible heater member, the first flexible heater member being disposed in the first serpentine groove and configured to conform with the shape of the first serpentine groove.

In accordance with an aspect of the invention there is provided a method of forming a sheet metal member in a forming system, the forming system comprising a first die assembly having a first die surface and a second die assembly having a second die surface, wherein the first die surface and the second die surface have three dimensional surface configurations and are configured to cooperate with each other to form a die cavity therebetween so as to receive a workpiece therein, a first heater insert member configured to be received in the first die body, the first heater insert member having a first serpentine groove therein and a first flexible heater member disposed in the first serpentine groove and configured to conform with the shape of the first serpentine groove; the method comprising: moving the first die assembly relative to the second die assembly along a first axis to move the die cavity from an open position to a closed position, heating the first flexible heater member using a heat source, to thereby heat the first heater insert member, and wherein heating the first flexible heater member transfers heat to the first die surface during forming the sheet metal member.

In accordance with an aspect of the invention there is provided a forming system for forming a pillar of an automobile comprising: a first die assembly having a first die body and a first die surface; a second die assembly having a second die body and a second die surface; the first die surface and the second die surface having varying cross sections and configured to cooperate with each other to form a die cavity therebetween so as to receive a workpiece therein, a first heater insert member configured to be received in one of the first die body and the second die body, the first heater insert member having a first serpentine groove therein, and a first flexible heater member, the first flexible heater member being disposed in the first serpentine groove and configured to conform with the shape of the first serpentine groove, wherein the first heater insert member has a top hat shaped configuration including a top portion, a pair of shoulder portions, and a pair of transition portions and wherein the first flexible heater member and first serpentine groove extend along at least a portion of the periphery of the top, shoulder, and transition portions of the first heater insert member.

Other aspects, features, and advantages of the present disclosure will become apparent from the following detailed description, the accompanying drawings, and the appended claims.

DETAILED DESCRIPTION OF THE PREFERRED EMBODIMENT(S)

Figure 1A:
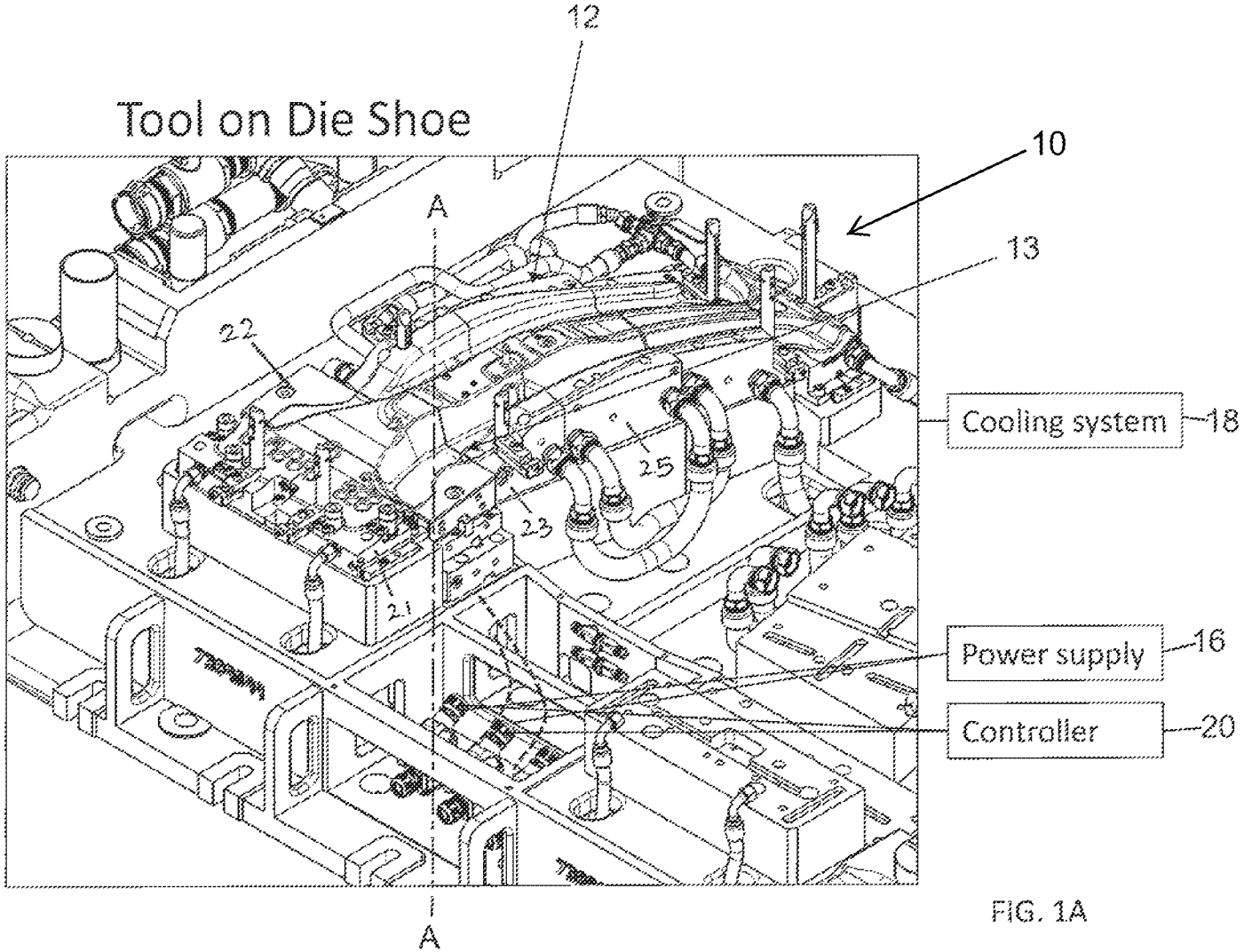
FIGS. 1A and 1B are diagrams of a first die assembly and a second die assembly, respectively, that form a hot stamping/forming system in accordance with an embodiment of the present disclosure.

This disclosure relates to a forming system 10 for producing a sheet metal part, such as a vehicle body member or panel, or a pillar of an automobile. The forming system 10 may be a hot forming system or a stamping die system. In particular, the forming system 10 is configured to form shaped metallic products having tailored properties. Forming "tailored" properties of products or parts using the system 10 and method herein described provides shaped parts that have regions of high strength and hardness as well as other regions of reduced strength, ductility, and hardness. When the herein described forming system 10 is used as part of a method of forming such a tailored product or part, such as vehicle pillars (A or B pillars), the resulting vehicle structure has a complex configuration that includes regions that are engineered to deform in a predetermined manner upon receiving a force resulting from a vehicular crash, for example.

As previously noted, to form such complex and tailored parts, heat is typically applied locally to certain areas during formation and cooling of a workpiece, so that localized regions are cooled less rapidly (as compared to other regions) to thus provide the part with higher ductility. The forming system 10 disclosed herein is designed to reduce temperature discrepancy along the heated areas of the die or stamp, and to reduce cost during tooling machining, assembling, and maintenance. It allows for the formation of a soft zone 42 in workpieces 40 by producing complex 3D structures in addition to regions of high strength and hardness therein.

Throughout this disclosure, a "two-dimensional" surface refers to a surface that, when cross sections are cut along a parallel plane in one direction along an entire length of the workpiece, a same or similar profile is obtained. An example of such a part having a "two dimensional" surface (on a die surface with a two-dimensional surface) is shown in FIG. 1C, which provides a substantially similar or same cross-section when cut in spaced positions along a direction as indicated by arrow X. As illustrated in FIG. 1E, for example, cross-sections taken along lines A-A, B-B, and C-C of the formed workpiece have substantially similar profile. A "three-dimensional" surface refers to a surface that, when cross sections are cut along a parallel plane in one direction along an entire length of the workpiece, there will be varying cross sections. FIG. 1D shows an example of a workpiece having such a "three-dimensional" surface on a die with a three-dimensional surface, wherein cuts along a direction as indicated by arrow Y of the formed workpiece or part will provide different profiles. As illustrated in FIG. 1F, for example, cross-sections taken along lines D-D, E-E, and F-F of the formed workpiece have different profiles because the die surface(s)—and thus the workpiece/part—of FIG. 1D has a varying cross section.

As used herein, the term "die surface" refers to the portion of the exterior surface of a die that forms a hot formed component and comes in direct contact with the portions of the workpiece. Moreover, the term "complex die surface" as used in this description means that the die surface has a varying cross section and three-dimensionally contoured shape designed to form complex 3D structure(s) or surface(s) (such as shown in FIG. 1D and FIG. 1F) that have lesser strength and hardness (and higher ductility) in some regions as compared to other regions of a workpiece.

Figure 1B:
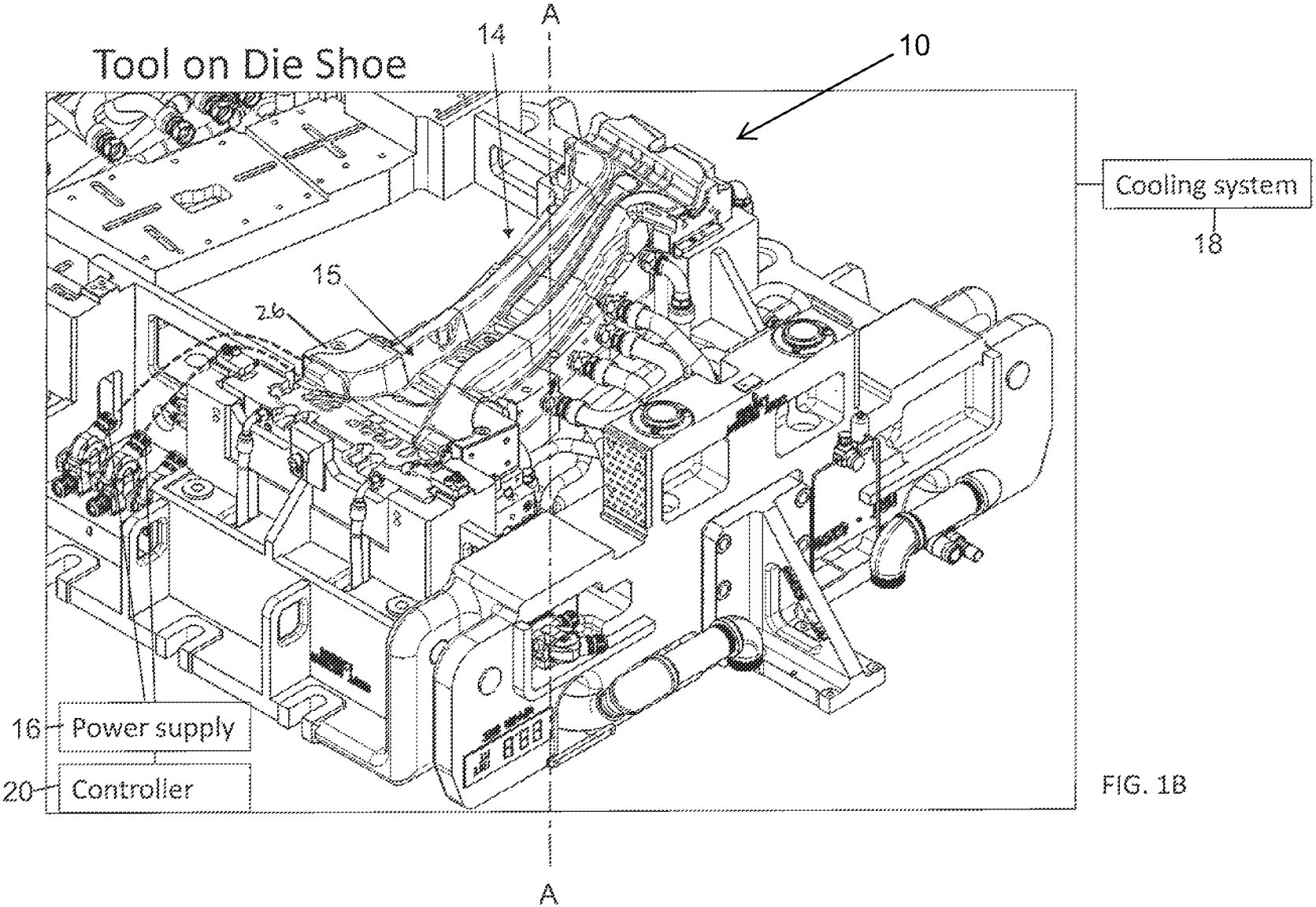
Figure 1C:
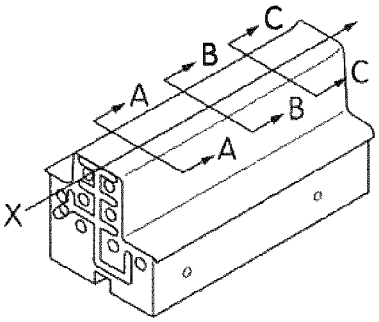
FIGS. 1C and 1D illustrate examples of a two-dimensional surface and a three-dimensional surface, respectively, as defined in this disclosure.
Figure 1D:
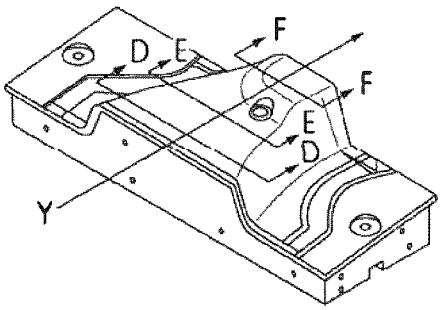
Figure 1E:
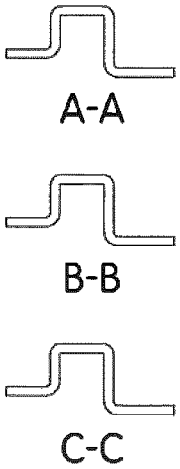
FIGS. 1E and 1F illustrate examples of cross sections taken along FIGS. 1C and 1D, respectively.
Figure 1F:
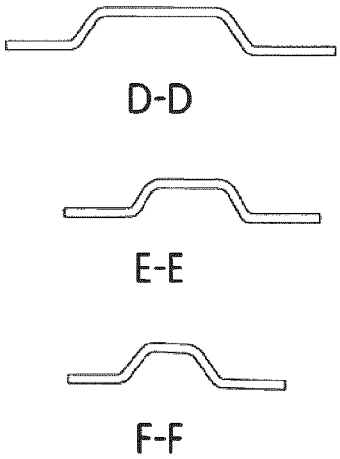

As shown in FIGS. 1A and 1B, the forming system 10 includes a first die assembly 12 (FIG. 1A), a second die assembly 14 (FIG. 1B), as well as a power (heat) supply 16, a cooling system 18, and controller 20 (schematically shown in the Figures) that are operatively associated with the first die assembly 12 and the second die assembly 14.

In an illustrative embodiment, the first die assembly 12 is shown as a lower die assembly. FIG. 1A illustrates a lower die assembly on a die shoe, for example. The first die assembly 12 may be formed from a number of die parts 21, 22, 23, and 25 that are aligned to form a die surface 13 to form a workpiece 40, such as a vehicle pillar (see FIG. 2). The second die assembly 14 is an upper die assembly that has an interior die surface 15 that is essentially a mirror image of the die surface 13 of the first die assembly 12, forming the die cavity therebetween. The second die assembly 14 may similarly be formed from a number of aligned die parts. The lower die assembly 12 may be mounted in a stamping press or ram (not shown) to enable upwards and downwards movement of the lower die assembly 12 relative to a mounted upper die assembly 14. In another embodiment, the upper die assembly 14 is configured to move relative to a mounted lower die assembly 12. The stamping press or press ram may be driven hydraulically or mechanically (e.g., by an electric motor).

Figure 2:
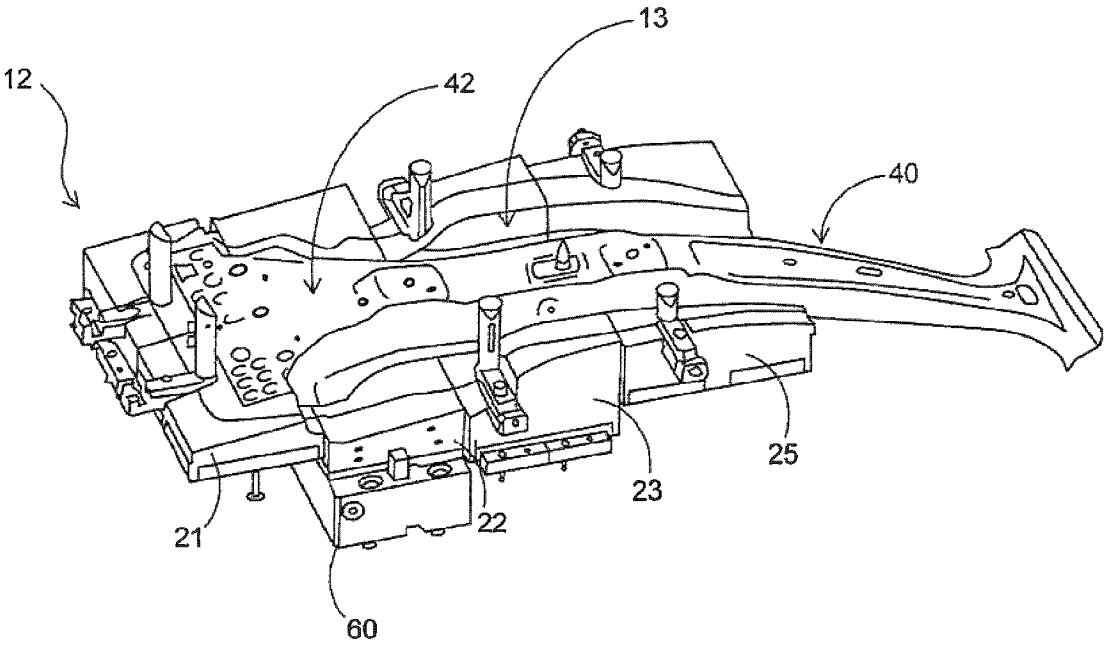
FIG. 2 is a schematic diagram of a workpiece formed as a result of using the dies of the hot stamping system of FIGS. 1A and 1B.
Figure 12:
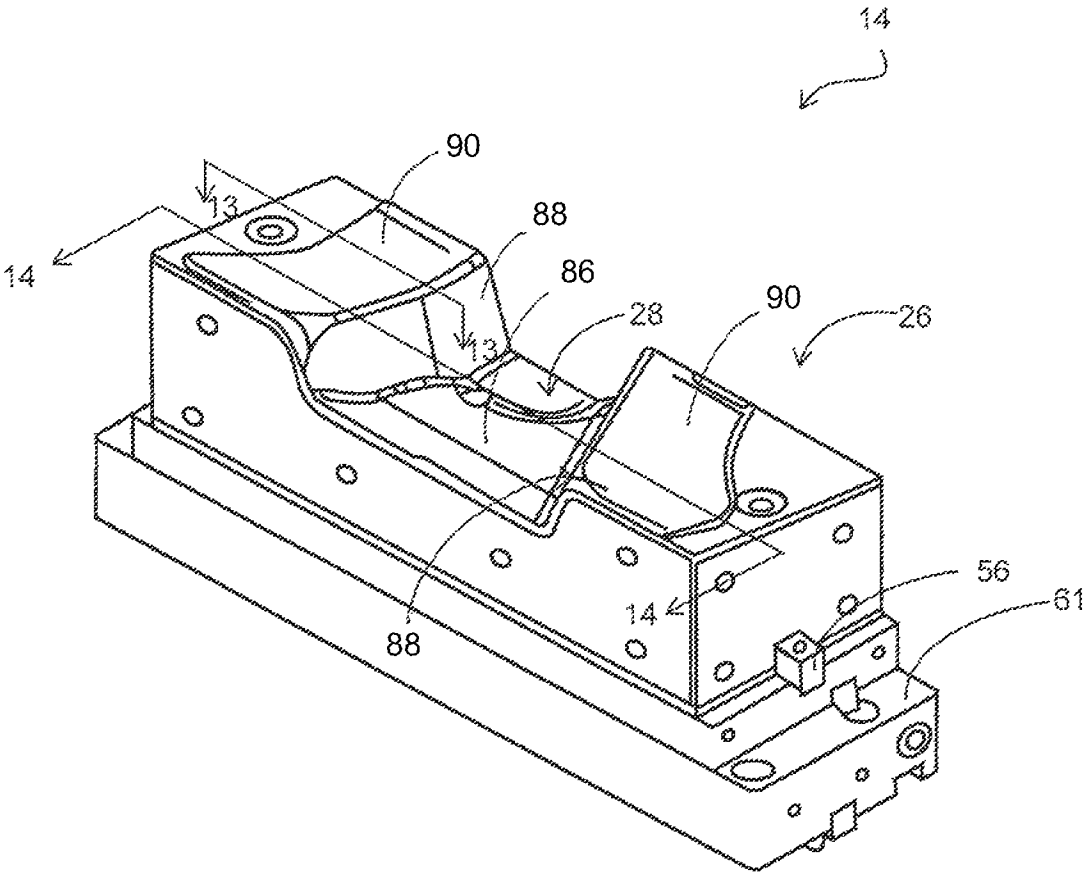
FIG. 12 is a top plan view of an upper die body as shown in FIG. 1B that is part the hot stamping/forming system.

As shown in detail in FIG. 2, the first die assembly 12 includes a first die body 22 and a first die surface 24 (see FIG. 6) in accordance with an embodiment. Similarly, the second die assembly 14 includes a second die body 26 and a second die surface 28, as shown in FIG. 12. The first die surface 24 and the second die surface 28 have three dimensional surface configurations (as described with reference to FIGS. 1D and 1F) that are complimentary and configured to cooperate with each other to form a die cavity therebetween so as to receive a workpiece 40 therein. In accordance with an embodiment, both the first die surface 24 and the second die surface 28 include a complex die surface. Accordingly, the die bodies 22 and 26 may be bodies designed to be positioned in an area of the forming system 10 that corresponds to the formation of complex 3D surfaces in a soft zone 42 of a workpiece 40 or product that have reduced strength and hardness. As shown in FIG. 2, the die bodies 22 and 26 may be used along with other die bodies [e.g., dies 21, 23, 25] to form different regions of the workpiece 40.

Figure 6:
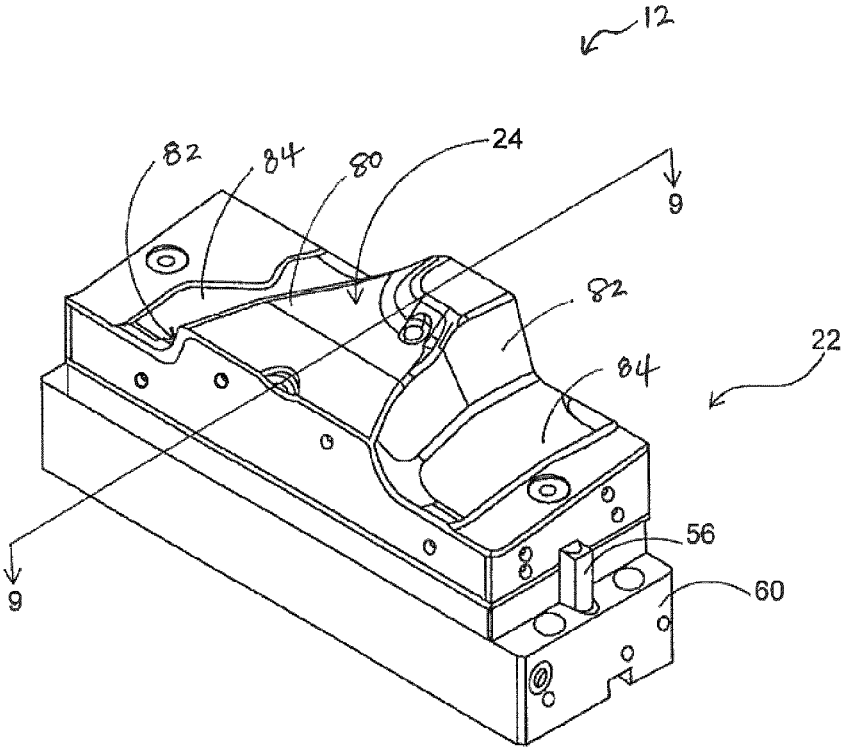
FIG. 6 is a top plan view of a lower die body as shown in FIG. 1A that is part of the die assembly of the hot stamping/forming system.

FIG. 6 shows an example of a complex die surface 24 of the first die body 22. The die surface 24 includes an upper surface 80, a pair of transition surfaces 82, as well as a pair of shoulder surfaces 84. The upper surface 80 and pair of shoulder surfaces 84 are generally parallel to one another, with the upper surface 80 generally positioned in a plane that is above a plane of the shoulder surfaces 84, in accordance with an embodiment. Of course, it should be understood that the notation of being provided generally in a plane with regards to each of the surfaces 80, 82, and 84 does not limit the configuration of the surfaces, and, as such, it should be understood that the surfaces 80, 82, and 84 are necessarily straight or flat and could include transitions and changes in and along the surfaces, as shown in the Figures and as understood by the definition of a complex die surface and three dimensional surface, provided above. The transition surfaces 82 connect the upper surface 80 and shoulder surfaces 84. The transition surfaces 82 may be slightly angled relative to the parallel surfaces of the upper and shoulder surfaces 80, 84, for example. Each of the surfaces 80, 82, and 84 is used to form complex surfaces of the workpiece 40. Similarly, an example of a complex die surface 28 of the second die body 26 that is complimentary to the first die surface 24 is shown in FIG. 12. The die surface 28 includes an upper surface 86, a pair of transition surfaces 88, as well as a pair of shoulder surfaces 90. In accordance with an embodiment, the upper surface 86 and pair of shoulder surfaces 90 are generally parallel to one another, with the upper surface 80 generally positioned in a plane that is above a plane of the shoulder surfaces 90 when the second die body 26 is positioned relative to the first die body 22. The transition surfaces 88 connect the upper surface 86 and shoulder surfaces 90. The transition surfaces 88 may be slightly angled relative to the parallel surfaces of the upper and shoulder surfaces 86, 90, for example. The dies 22, 26 and thus their respective surfaces 24, 28 are moved for stamping and forming the workpiece 40 therebetween.

As generally understood in the art, movement of one of the die assemblies (e.g., the first die assembly 12) relative to the other die assembly (e.g., a mounted second die assembly 14) is provided along a first axis A-A to move the die cavity between an open position and a closed position. In one embodiment, the first axis A-A may be a longitudinal axis of the forming system 10. In one embodiment, the second/upper die assembly 14 is movable with respect to the first/lower die assembly 12 from an open position in which the die assemblies 12 and 14 are separated from each other to a closed position in which the die assemblies 12 and 14 form the closed die cavity. In one embodiment, the first die assembly 12 is fixedly mounted in the forming system or the stamping press. In one embodiment, the first die assembly 12 and the second die assembly 14 may be mounted in the forming system 10. The forming system 10 may be configured to close the first and second die assemblies 12 and 14 in a die action direction (i.e., along or parallel to the first axis A-A) to deform the workpiece 40 received in the die cavity so as to form and optionally trim a hot formed member. In one embodiment, the stamping press may be configured to maintain the die assemblies 12 and 14 in a closed relationship for a predetermined amount of time to permit the formed member to be cooled to a desired temperature.

The workpiece 40 may be heated using a hot forming operation (e.g., to an austentizing temperature) before insertion between the first and the second die surfaces 24 and 28 of the die assemblies 12 and 14. In an embodiment, the blank or workpiece 40 is heated up to approximately 900 degrees Celsius before entering the dies of the forming system 10. After insertion of the workpiece, the die cavity is closed via movement of one or more of the dies 12 and 14 relatively together, and the hot formed workpiece 40 is formed.

Figure 2A:
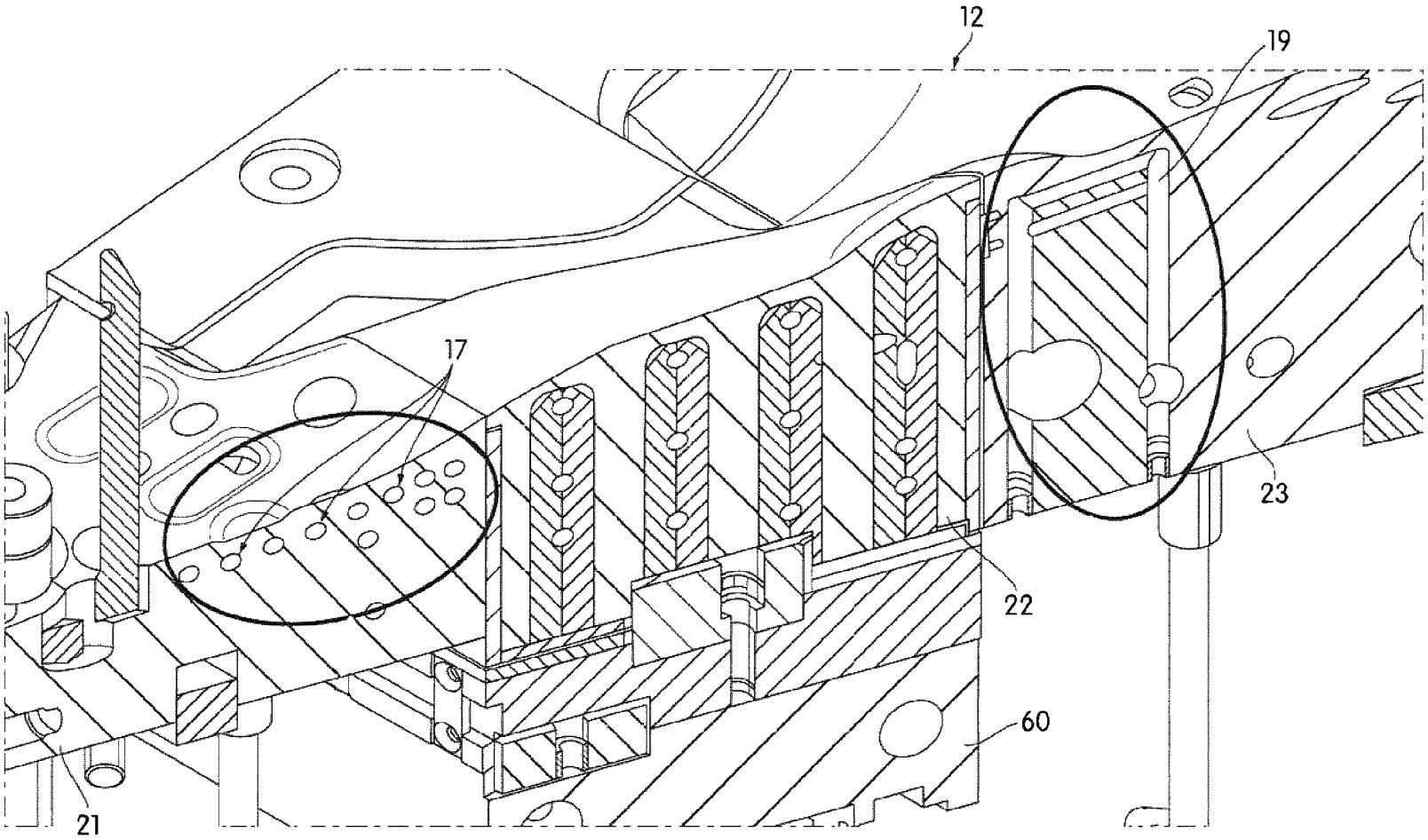
FIG. 2A is a schematic diagram of cooling channels and devices used in die parts of the hot stamping system.

When the workpiece 40 is received in the die cavity formed by the assemblies 12 and 14, at least part of the workpiece is positioned between the first die surface 24 and the second die surface 28. All of the first and second die surfaces are on opposite sides of each other when the die is closed; some of the die surfaces (e.g., those surfaces associated with die parts 21, 23, and 25) are designed to provide localized regions of heat and rapid cooling (quenching) and the die surfaces 24, 28 are designed for forming one or more soft zones 42 in the workpiece 40. For example, as shown in FIG. 2A, die parts 21, 23 may include cooling channels 17, 19 (as shown within the ovals that are drawn in FIG. 2A) that receive fluid (e.g., water) via openings to flow therethrough to absorb heat and thus cool down the block/part such that the parts of the workpiece 40 are quenched quickly. On the other hand, a soft zone block, i.e., the first die body 22 (along with its corresponding upper die) is designed to apply localized heat throughout the length of the production process, and thus the adjacent part of the workpiece 40 is cooled at a slower rate. In one embodiment, this zone is maintained at approximately 550 degrees Celsius [during the production process]. In an embodiment, the blank/workpiece 40 in this area is maintained at approximately 550 degrees.

In accordance with an embodiment herein, one or more heater insert members 30 (see FIG. 3) are provided within either or both of the first die body 22 and/or the second die body 26 to apply the localized heat in this soft zone. The heating insert members 30 may be inserted into the form block of the die body 22 and/or 26. Each heater insert member 30 is designed to conduct heat from a heating element to the related die body to form the complex features of the workpiece.

In one embodiment, each heating insert member 30 has a generally winding or serpentine groove 38 for receiving a flexible heater member 36 therein that conforms to the shape of the serpentine groove 38. The serpentine groove 38 of each heater insert member 30 follows the 3D complex die surface of die surface 24 and/or die surface 28. Accordingly, the insert member(s) 30 and flexible heater member(s) 36 allow for close positioning of heat adjacent to the die surface(s) 24, 28 and thus more uniform heating thereof. Uniform heating of the die surface(s) 24 and/or 28 thereby results in a higher quality workpiece 40 with a soft zone of complex 3D surfaces.

Figure 4:
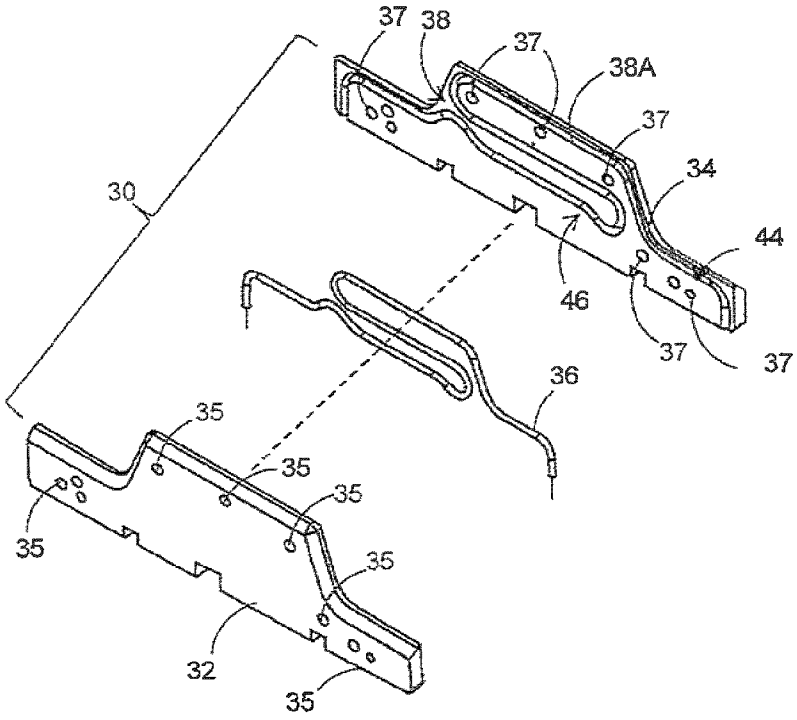
FIG. 4 is an exploded view of parts of the heater insert member of FIG. 3.
Figure 5:
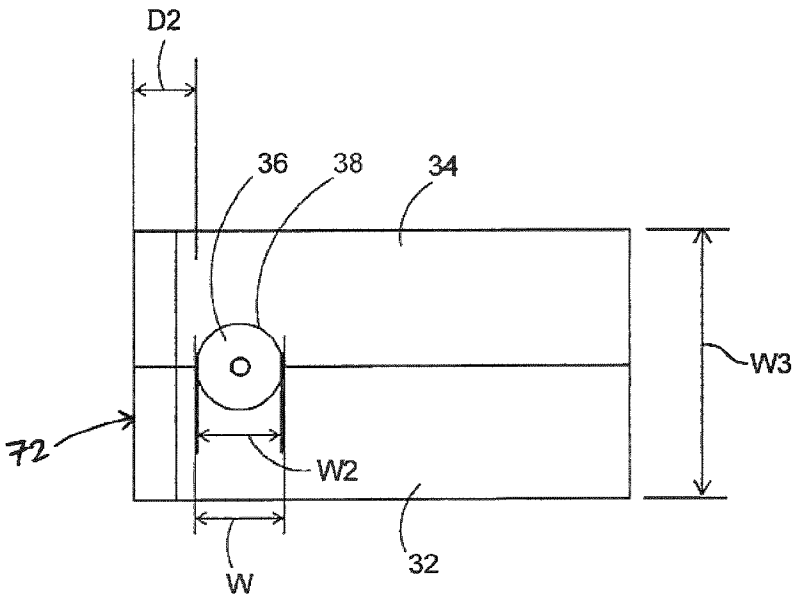
FIG. 5 is a cross-sectional view of a flexible heater member sandwiched between parts of the heater insert member of FIG. 3 as taken along line 5-5.

In accordance with an embodiment, the heater insert member 30 is formed from a pair of plates 32 and 34 that sandwich the flexible heater member 36 therebetween, as illustrated in FIGS. 4 and 5, for example. In an embodiment, each plate 32 and 34 has a groove portion 38A therein that forms part (i.e., half) of the serpentine groove 38 within the insert member 30. The plates 32 and 34 may be secured to each other via securing attachment devices or fasteners placed into holes or openings 35 and 37 within the plates 32 and 34. The flexible heater member 36 is disposed between the plates 32 and 34 within the serpentine groove 38 when the plates 32, 34 are secured together (see FIG. 5).

Figure 3:
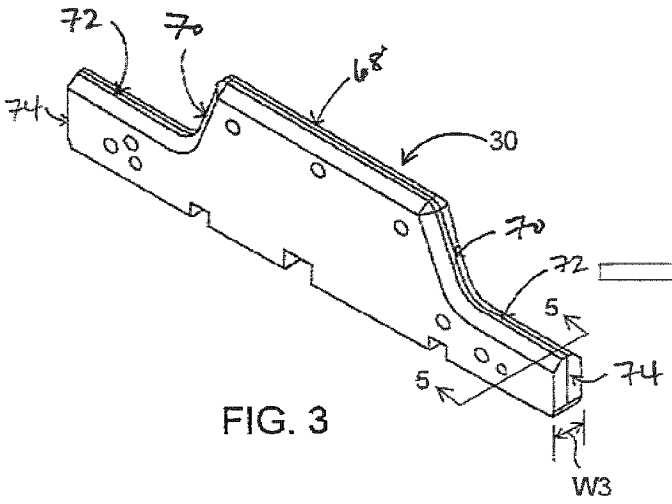
FIG. 3 is a plan view of a heater insert member provided in a die body of a die assembly such as those shown in FIGS. 1A and 1B.
Figure 5A:
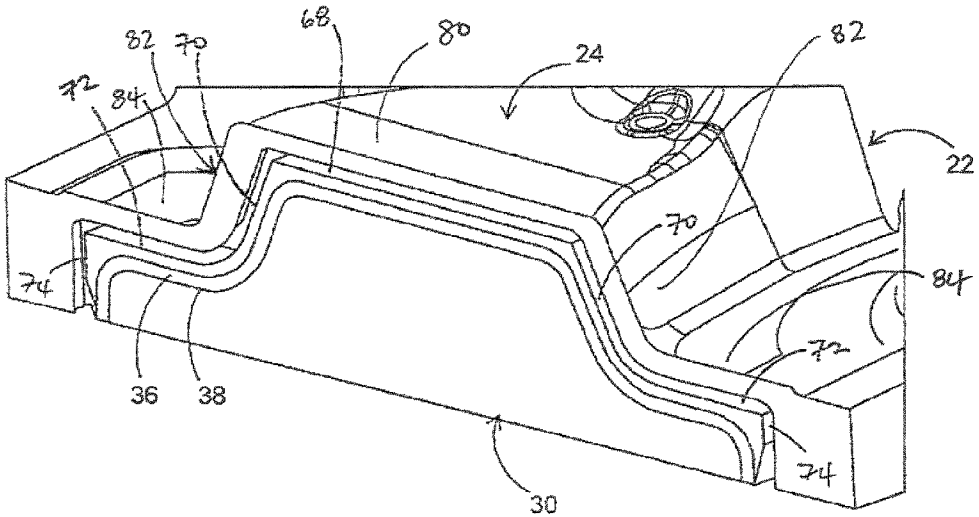
FIG. 5A is a cross sectional view of a die body showing the flexible heater member of FIG. 5 in groove that follows a similar shape to a die surface of a die body.

In one embodiment, the heater insert member 30 has configuration that is dependent upon and/or generally corresponds to the die surface and die body it is associated with. For example, referencing the first die body 22 with first die surface 24 of FIG. 6, the heater insert member 30 may have a top hat shaped configuration, as illustrated in FIG. 3, for example, which may include a top portion 68, a pair of transition portions 70, and a pair of shoulder portions 72, that correspond to the upper surface 80, pair of transition surfaces 82, and the pair of shoulder surfaces 84. The top portion 68 and pair of shoulder portions 72 may each have a [top] end surface or edge that are generally parallel to one another, in accordance with an embodiment. The transition portions 70 have end surfaces that connect the top and shoulder portion ends surfaces. The transition portions 70 may be slightly angled relative to the parallel surfaces of the top and shoulder portions 68, 72, for example. The heater insert member 30 may also have side portions 74. The side portions 74 may have end surfaces or edges that are perpendicular to the parallel surfaces of the top and shoulder portion end surfaces, for example. FIG. 5A shows an example of the corresponding configurations of the heater insert member 30 surfaces 68, 70, and 72 to the surfaces 80, 82, and 84 of the die. The top portion 68 of the heater insert member 30 is positioned adjacent to the upper surface 80 of the die, the transition portions 70 of the heater insert member 30 are positioned adjacent to the transition surfaces 82 of the die, and the shoulder portions 72 of the heater insert member 30 are positioned adjacent to shoulder surfaces 84 of the die. The side surfaces 74 may be positioned adjacent an inner side surface of the die. It should be understood that a similar setup, i.e., positioning of the portions 68, 70, and 72 (and/or 74) of the heater insert member 30 adjacent to the surfaces 80, 82, and 84 within an upper die 26 of complimentary shape may also be employed.

Accordingly, each pair of plates 32 and 34 (of each heater member 30) that sandwiches the flexible heater member 36 therebetween may also have a top hat shaped configuration, forming one half or side of the top hat shape of the heater insert member 30. Each plate 32, 34 may include one-half of the top portion 68, transition portions 70, shoulder portions 72, and side portions 74 of the heater insert member 30 (see FIG. 10), thereby forming the top hat shaped configuration when assembled and secured together. The groove portions 38A in each plate 32, 34, and thus the flexible heater 36, may be provided near and around at least the top portion 68, transition portions 70, and shoulder portions 72, for example.

Figure 11:
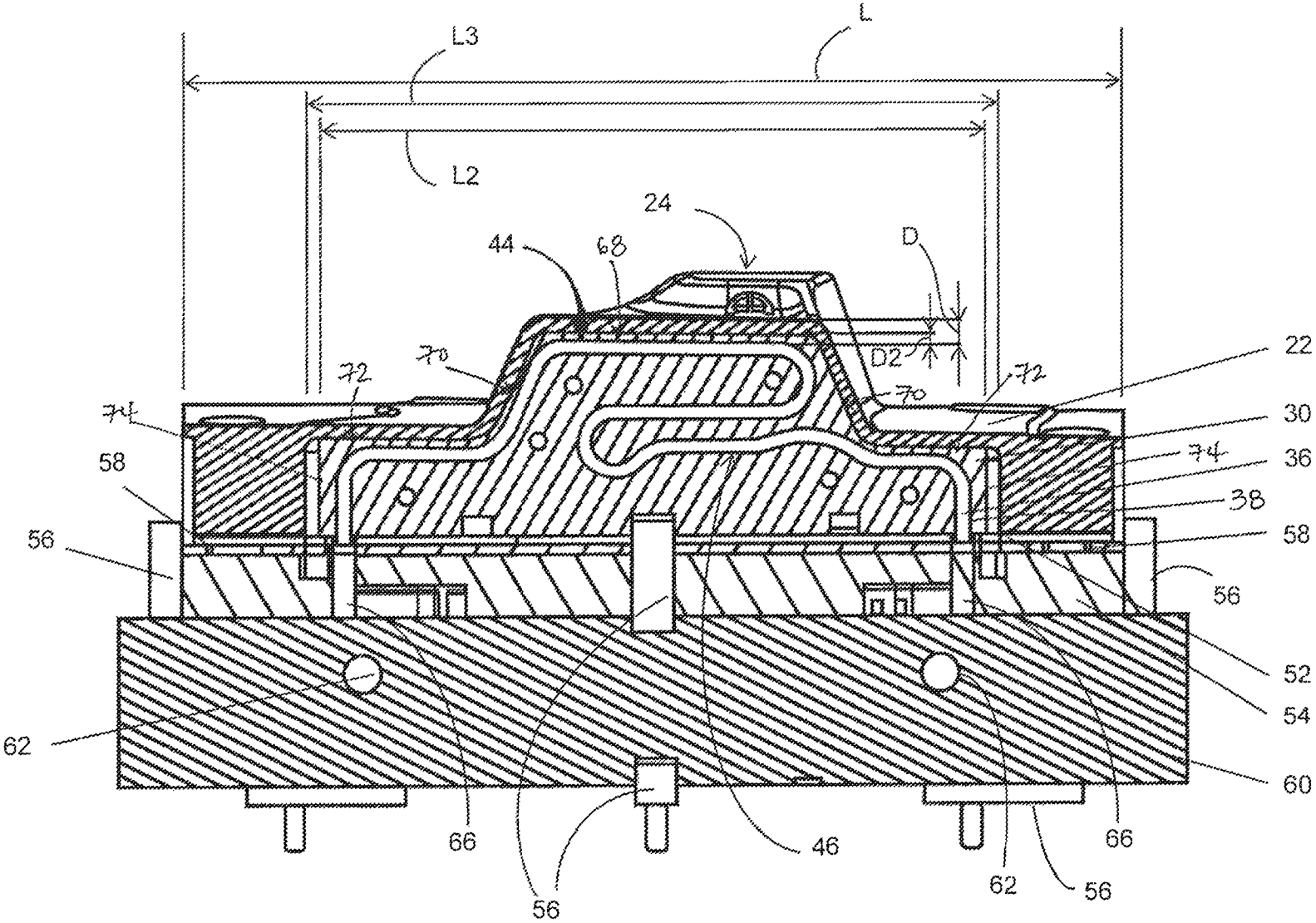
FIG. 11 is a cross-sectional view of the lower die body taken along line 11-11 in FIG. 9.

In one embodiment, as seen in FIG. 4 and FIG. 11, for example, the serpentine groove 38 has a first portion 44 that is disposed generally along at least a portion of the periphery of the heater insert member 30 (see also FIG. 5A). Accordingly, in an embodiment, at least a portion (e.g., first portion 44) of the flexible heater member 36 is disposed generally along at least a portion of the periphery of the heater insert member 30. The serpentine groove 38 and thus flexible heater member 36 may extend along at least a portion of the periphery of the top, shoulder, and transition portions 68, 72, 70 (respectively) of the heater insert member 30, for example. In an embodiment, the flexible heater member 36 and serpentine groove 38 extend along an entire periphery of the top, shoulder, and transition portions 68, 72, 70 of the heater insert member 30. The serpentine groove 38 may further include a second portion 46 extending within a central portion of the heater insert member 30 that is inside the periphery of the heater insert member 30 (see FIG. 4). The serpentine groove 38 may include any number of bends or turns within the heater insert member 30.

As illustrated in FIG. 5, in an embodiment, the serpentine groove 38 (and the flexible heater therein) is spaced at a distance D2 that is less than approximately 12 mm from the top and shoulder portion end surfaces of the heater insert member 30. In one embodiment, the distance D2 is approximately 2 mm to approximately 6 mm. In one embodiment, the distance D2 is approximately 4 mm. In another embodiment, the distance D2 between the serpentine groove 38/flexible heater member 36 and an end surface of the heater member 30 is approximately 8 mm to approximately 33 mm. In another embodiment, the distance D2 between the serpentine groove 38/flexible heater member 36 and an end surface of the heater member 30 is approximately 10 mm to approximately 28 mm. In yet another embodiment, the distance D2 between the serpentine groove 38/flexible heater member 36 and an end surface of the heater member 30 is approximately 10 mm to approximately 13 mm. In still another embodiment, the distance D2 between the serpentine groove 38/flexible heater member 36 and an end surface of the heater member 30 is approximately 23 mm to approximately 28 mm.

The size and/or dimensions of the serpentine groove 38 may be dependent upon the type of flexible heater member 36 used in the heater insert member 30, or vice versa. For example, if the flexible heater member 36 has a rounded geometry, the serpentine groove 38 may also include a rounded geometry. If the flexible heater member 36 has a rectangular or square geometry, the sides of the serpentine groove may be linear to accommodate the shape of the flexible heater member 36.

In accordance with an embodiment, the width W (see FIG. 5) of the serpentine groove 38 is between approximately 5.5 mm and approximately 10.5 mm. In one embodiment, the width W is between approximately 7.5 mm and approximately 9.5 mm. In yet another embodiment, the width W is approximately 8.5 mm. The flexible heater member 36 has a width W2 that is at least slightly less than the width W of the serpentine groove 38. In an embodiment, the serpentine groove 38 is sized such that the flexible heater member 36 may be press-fit into the groove 38.

The serpentine groove 38 may be formed in the insert member 30 in any number of ways. For example, it may be molded as part of the insert member 30 (e.g., molded as part of a plate 32 or 34) or machined therein.

The flexible heater member 36 as provided herein is a device that is configured for flexion and bending to conform to an area or surface which will be heated and that capable of rapid heating when heat is applied thereto by a heat or power source. The flexible heater member 36 has connector ends for connection to a power or heat source 16, for example. The type and/or shape of the connector ends should not be limited. For example, the connector ends may include: a terminal connector for plug in to a source, a threaded pin, plain or insulated leads, sealed mineral fibers, and/or a flat plug, for example. In an embodiment, the flexible heater element 36 has about 2500 W.

In one embodiment, the flexible heater member 36 is designed to be powered such that it maintains the die body 22 at approximately 550 degrees Celsius. In an embodiment, the flexible heater member 36 may be heated to approximately 700 degrees C./1290 degrees F. The power/heat source 16 associated with the flexible heater member 36 may be the same as the heat source for the forming system 10 or a separate, dedicated heat source used to power the flexible heater member(s) 36 of the heater insert member(s) 30.

In accordance with an embodiment, the flexible heater member 36 is formed from a wire encased by an insulator that is optionally further enclosed by a tubular section. For example, the wire may be a copper rod covered by high temperature fiber glass. In some cases, a ceramic lead may be used to protect wires. In one embodiment, a sheath of stainless steel is provided around the wire and insulator.

As previously described, the flexible heater member 36 may have a design or shape that affects the geometry of the serpentine groove 38 formed in the heater insert member(s) 30. In one embodiment, an outer surface of the flexible heater member 36 (such as the outside of an insulator or tubular section) has a rounded geometry. In another embodiment, an outer surface of the flexible heater member 36 has a rectangular or square geometry. A cross section of the flexible heater member 36 used in the heater insert member 30 may be round, rectangular, or square. The design or shape of the outside and cross section of the flexible heater member 36 is not intended to be limiting.

Also, an entire length of the flexible heater member 36 need not be flexible. For example, a portion or length near the connection ends of the flexible heater 36 may be stiff or not bendable. The end portions may be provided in a cold zone along the heater, for example.

The flexible heater member 36 may be any type of flexible tubular heater device that may conform and/or be shaped to the heater member 30. For example, in one embodiment, the flexible heater member 36 is a Hotflex® tubular heater.

Figure 7:
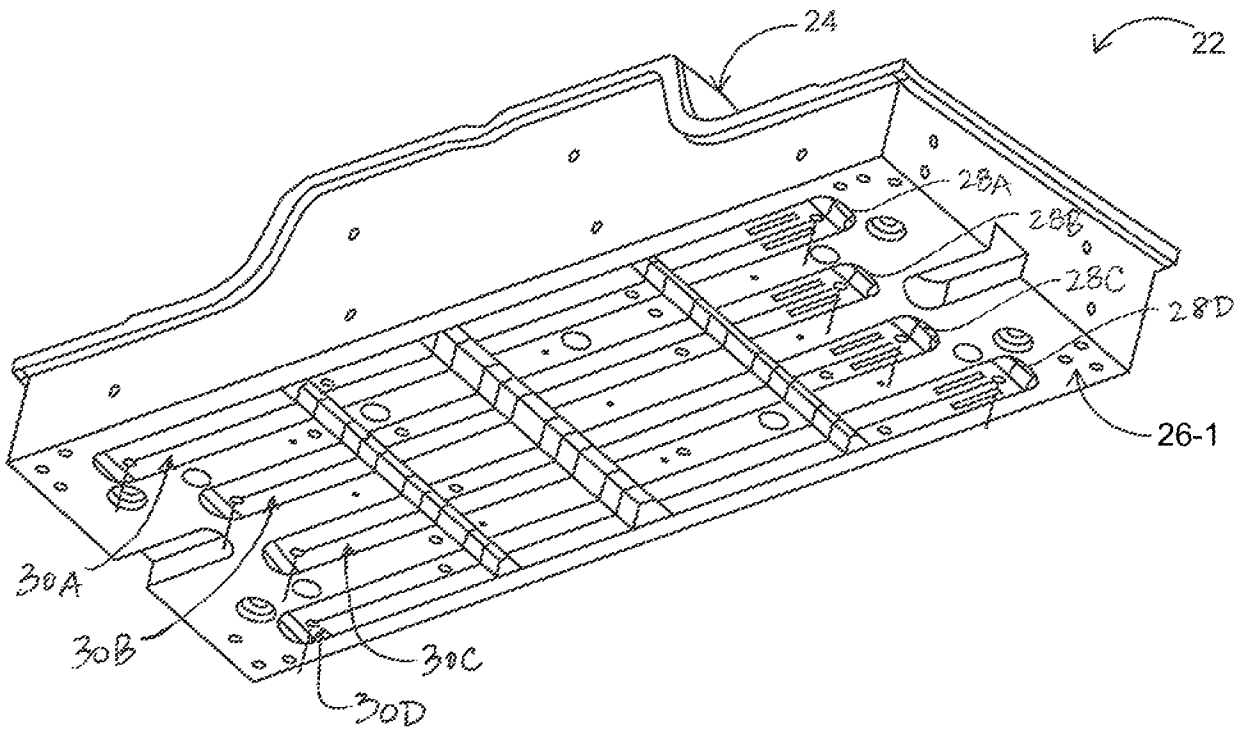
FIG. 7 is a bottom plan view of the lower die body of FIG. 6.
Figure 8:
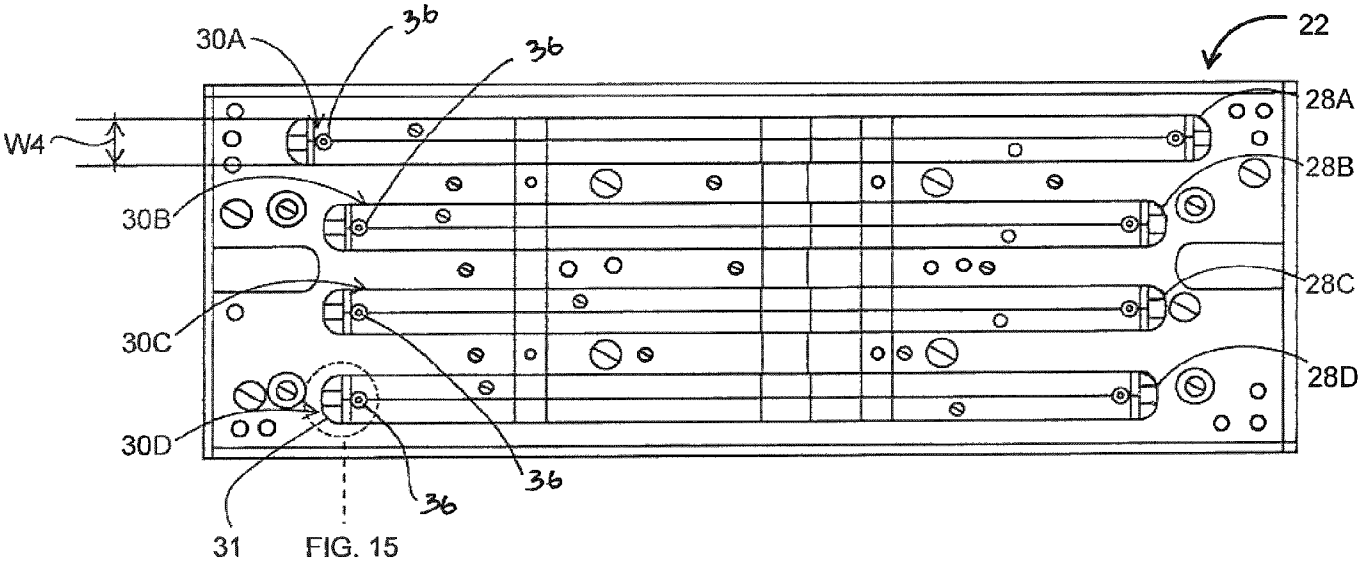
FIG. 8 is a bottom view of the lower die body of FIG. 6.

Any number of heater members 30 may be provided in the first die body 22 and/or the second die body 26. FIGS. 6, 7 and 8 illustrate multiple views of the first (lower) die body 22 having multiple heater insert members 30 therein in accordance with one embodiment. Specifically, heater members 30 are configured to be inserted through slots provided in a bottom surface 26-1 of the die body 22. In the illustrated embodiment, the first die body 22 has a number of slots 28A, 28B, 28C, and 28D therein for receipt of heater insert members 30A, 30B, 30C, and 30D. Each of the slots 28A, 28B, 28C, and 28D may have a shape that corresponds to the heater insert members 30A, 30B, 30C, and 30D, in one embodiment.

Each of the slots 28A, 28B, 28C, and 28D has a height that extends upwardly from the bottom surface 26-1 into the die body 22 towards the die surface 24, and a length that runs laterally between sides of the die body 22. The width W of each slot 28A, 28B, 28C, and 28D corresponds to a width W3 of a heater insert member 30.

In accordance with an embodiment, a lateral length L2 (see FIG. 11) of each the heater insert members—defined as a length from an (outer) edge of a shoulder portion 72 to an opposite (outer) edge of the opposite shoulder portion 72—is dependent upon a lateral length L of the first die body 22. In accordance with an embodiment, a lateral length L3 of each the slots (the length at which the slot extends across the first die body 22) is dependent upon a lateral length L of the first die body 22 and/or a length L2 the heater insert members 30 for insertion therein. In one embodiment, the length L3 of a slot is greater than the length L2 of the heater insert member 30.

Figure 9:
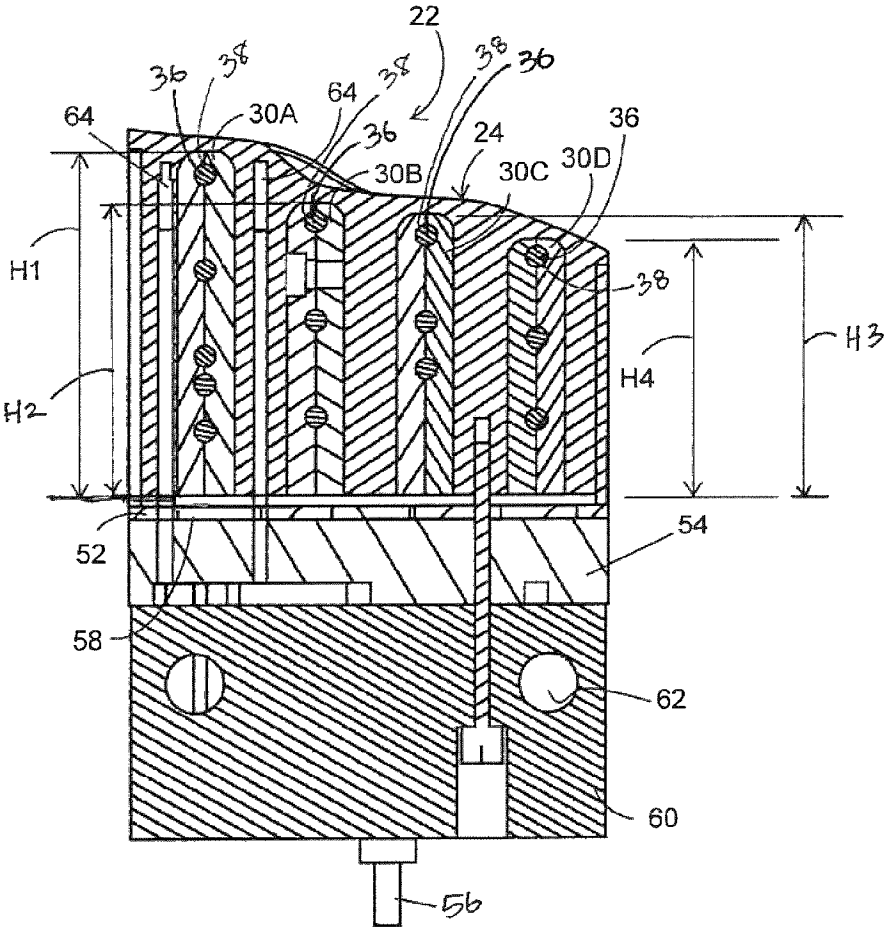
FIG. 9 is a cross-sectional view of the lower die body as shown in FIG. 6 as taken along line 9-9.

In accordance with an embodiment, an overall height of each of the heater insert members 30 is dependent upon a height of the first die body 22. In one embodiment, the height of each heater insert member 30 across the die body (in the lateral direction) varies and is based on the shape of the complex die surface 24; i.e., a height from the bottom edge to a top edge of shoulder portion 72 may differ from a height from the bottom edge to a top edge of the top portion 68. In accordance with an embodiment, a height of each of the slots is dependent upon a height of the first die body 22 and/or the heater insert members 30 for insertion therein. In one embodiment, the height of the slot across the die body (in the lateral direction) varies and is based on the shape of the complex die surface 24; i.e., the heights of/along the slot vary based on the heights of the shoulder, transition, and top portions of the heater insert members 30. For example, as seen in FIG. 9, each of the heater insert members 30A, 30B, 30C, and 30D is positioned within the slots 28A, 28B, 28C, and 28D such that they extend towards the complex first die surface 24. The shape of the first die surface 24 can determine the height and/or length of each slot and heater insert member (in the lateral direction), and cause variations in the height and/or length based on its shape. In one embodiment, the heater insert members may have similar lengths L2, but varying heights H1, H2, H3, and H4 (heights H1, H2, H3, and H4 as shown in FIG. 9 being measured from a bottom edge of the heater insert member 30 to a top edge of the top portion 68 thereof). In some embodiments, two or more heater insert members may have substantially similar or equal heights (e.g., H2=H3).

In accordance with an embodiment, the width W3 (see FIG. 5) of each heater insert member 30 is sized slightly less than the width W4 (see FIG. 8) of each slot 28A 28B, etc. such that the heater insert member 30 fits into the slot.

Figure 10:
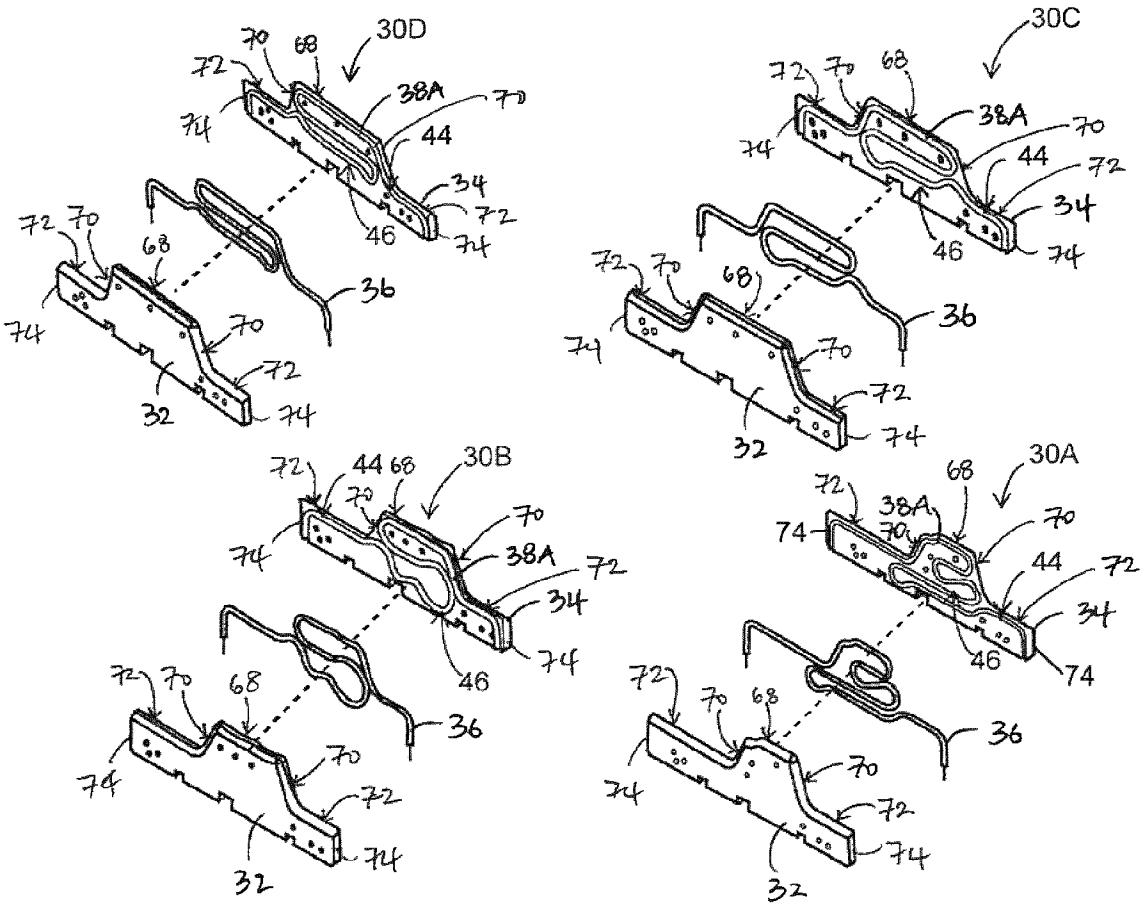
FIG. 10 shows exploded views of parts of multiple heater insert members configured to be provided in the lower die body as shown in FIG. 6 in accordance with an embodiment.

Further, features related to the serpentine groove 38 in each of the heater insert members 30A, 30B, 30C, and 30D can vary based upon the length L2 and/or height of the respective heater insert member. For example, the number of bends or turns in each of the heater insert members 30 may be more or less depending upon the length and height of the heater insert member. As such, the amount or total length (from end to end) of the flexible heater member 36 provided in each serpentine groove 38 can also vary. FIG. 10 shows exploded views of the parts of multiple heater insert members 30A, 30B, 30C, and 30D that may be provided in the first die body 22 as shown in FIG. 6. As illustrated, the bends and turns in both of the groove portions 38A (that, when the plates 32, 34 for each heater insert member are assembled and secured together, align to form the serpentine groove 38 of each heater insert member) provided in each of the plates 32, 34 and the bends and turns in the flexible heater member 36 may vary for each heater insert member 30A, 30B, 30C, and 30D. The configuration, placement, and shape of the grooves 38 in each heater insert member may be dependent upon the configuration, placement, and shape of the die surface the heater insert member 30 associated therewith (e.g., first die surface 24 or second die surface 28), and/or a position of the heater insert member 30 within the die body.

Although four slots 28A-28D and four heater insert members 30A-30D are shown in this described and illustrative embodiment, the number of slots and/or heater insert members is not intended to be limiting in any way. More or less slots and heater insert members may be provided in a die body. In an embodiment, the number of slots and heater insert members is dependent upon a size and structure of the die body, including its three-dimensional complex surface, such that the heater insert members can be laid out to maintain a generally consistent temperature across the surface and die body.

Despite the number of heater insert members 30, each heating insert member 30 is positioned against an underside of the first die surface 24 to closely position the flexible heater member 36 near the complex die surface. FIG. 11 shows an exemplary view the positioning of the flexible heater 36 in the serpentine groove 38 of the heater insert member 30 when inserted into the first die body 22 and configured for use. Because of the use of the heater insert member(s) 30, at least a portion (e.g., its first portion 44) of the serpentine groove 38 of each heater insert member may be formed to follow the shape of the 3D complex die surfaces of first die surface 24 (and/or die surface 28). Further, the serpentine groove(s) 38 (and the flexible heater therein) may be positioned at a distance D that is closer to the die surface 24 (and/or die surface 28) (as compared to known heating devices), and thus provides a more uniform distribution of heat to the respective die surface. In one embodiment, the distance D between the serpentine groove 38 and the die surface 24 and/or 28 is approximately 10 mm to approximately 35 mm. In another embodiment, the distance D between the serpentine groove 38 and the working die surface 24 and/or 28 is approximately 12 mm to approximately 30 mm. In yet another embodiment, the distance D between the serpentine groove 38 and the working die surface 24 and/or 28 is approximately 12 mm to approximately 15 mm. In still another embodiment, the distance D between the serpentine groove 38 and the working die surface 24 and/or 28 is approximately 25 mm to approximately 30 mm.

Figure 11A:
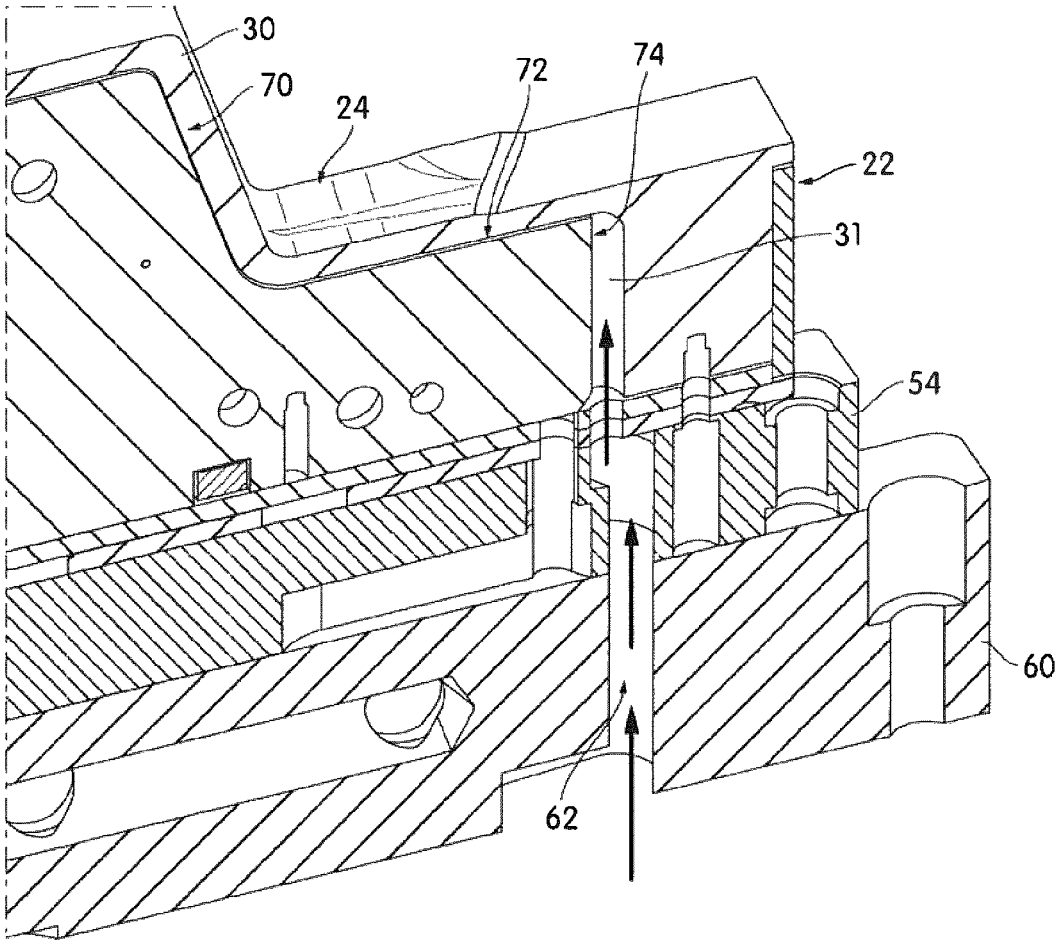
FIG. 11A illustrates a cross-section of part of the manifold and die body shown in FIG. 11.

Also shown in FIG. 11 are additional parts associated with the first die body 22 of the first die assembly 12. The first die body 22 is associated with and placed on a manifold 60 (see also FIG. 6) that is designed to block heat transfer from the die body 22 and heater elements 30 to the rest of the tool or forming system 10. The manifold 60 may include one or more cooling paths 62 therein to assist in cooling the manifold 60. FIG. 11A illustrates a cross-section of part of the manifold 60 showing an alternate view of an exemplary cooling path 62 having a delivery channel to deliver fluid (e.g., air) to channels 31 (see FIG. 15, further described below) that aids in regulating the temperature of the die body 22. As noted below, thermocouples 64 may be used to control the temperature of the die body 22. The cooling path(s) 62 may be cooled via fluid (e.g., water, air), for example.

Insulators 50 are positioned along sides of the first die body 22 to limit heat dissipation loss from the die body 22. Between the die body 22 and the manifold 60 is a sub-plate 54 that contains a path for air circulation and a path for electrical wiring to the die body 22 from a power or heat source. One or more pucks 58 are provided between the die body 22 and the sub-plate 54 to sustain the forming force when the die assemblies 12, 14 are forced together. A shim plate 52 is provided between the die body 22 and the pucks 58 so that any forming force may be evenly distributed to the pucks 58. The pucks 58 may be formed from ceramic, for example, and further block heat transfer from the die body 22 to the sub-plate 54. The sub-plate 54 includes channels 66 therein to provide an area for electrical connection of connector ends of the flexible heater elements 36 to connectors of a power source. Alignment key(s) 56 may be associated with the die body 22 and manifold 60 for alignment with openings of a second die body 26 and its respective manifold when the die assemblies 12, 14 are moved together and closed to form a workpiece.

Also part of the first die body 22 are thermocouples 64, as seen in FIG. 9. The thermocouples 64 are inserted into the die body 22 and designed to regulate the temperature of the die body 22 to a desired level of temperature. For example, the thermocouples 64 may be designed to regulate and control the temperature in the soft zone such that the workpiece 40 is maintain around 550 degrees Celsius. In an embodiment, the thermocouples 64 regulate the temperature of the die body 22 so that overheating does not occur. The thermocouples 64 may be set to a specific temperature (e.g., 550 degrees C.) to maintain the block at the set temperature (e.g., by working with a controller and a cooling system). The thermocouples 64 may be positioned in any number of areas within the first die body 22 and are not limited to the illustrated location of FIG. 9. A location and number of thermocouples provided in the die body 22 may be based on a desired heating distribution set by a customer, for example.

Figure 13:
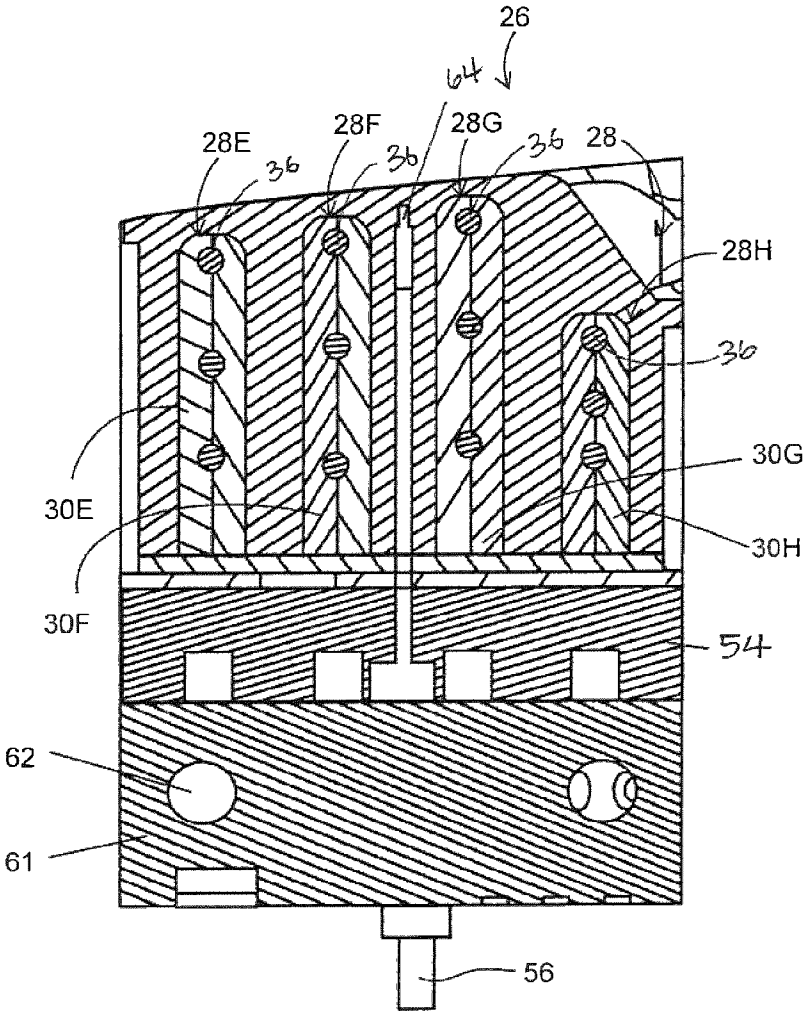
FIG. 13 is a cross-sectional view of the upper die body as shown in FIG. 12 as taken along line 13-13.
Figure 14:
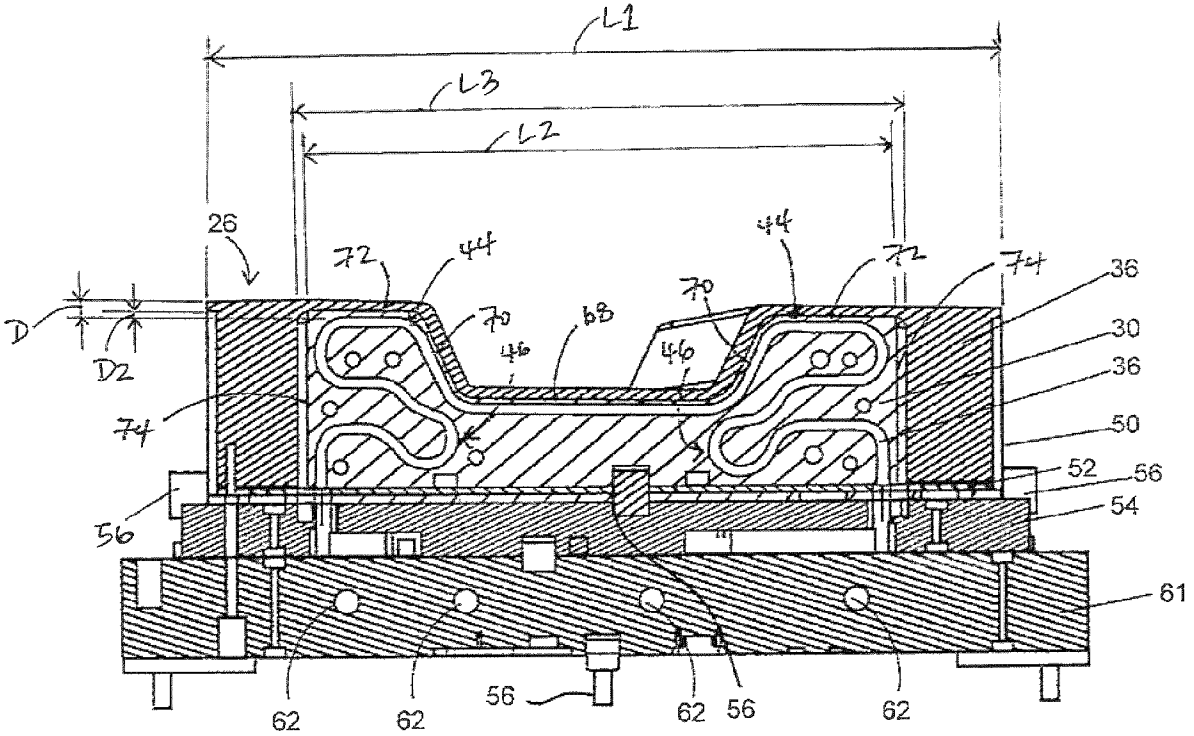
FIG. 14 is a cross-sectional view of the upper die body taken along line 14-14 in FIG. 12.

FIGS. 12, 13, and 14 illustrate multiple views of the second (upper) die body 26 having multiple heater insert members 30 therein in accordance with one embodiment. For simplicity purposes, parts previously described with reference to FIGS. 3-11 have been provided with the same reference numerals in FIGS. 12-14, and thus their description may not be fully repeated here. As previously noted, any number of heater members 30 may be provided in the second die body 26. Specifically, heater members 30 are configured to be inserted through slots provided in a bottom surface of the die body 26 in a similar manner as described previously with respect to first die body 22 and FIGS. 4-11. In the illustrated embodiment, the second die body 26 has a number of slots 28E, 28F, 28G, and 28H therein for receipt of heater insert members 30E, 30F, 30G, and 30H. Each of the slots 28E, 28F, 28G, and 28H may have a shape that corresponds to the heater insert members 30E, 30F, 30G, and 30H, in one embodiment.

The slots 28E, 28F, 28G, and 28H and heater insert members 30E, 30F, 30G, and 30H have similar features as previous described with respect to slots 28A, 28B, 28C, and 28D and heater insert members 30A, 30B, 30C, and 30D, and thus all details are not repeated here. Each of the slots 28E, 28F, 28G, and 28H has a height that extends upwardly from the bottom surface into the die body 26 towards the die surface 28, and a length that runs laterally between sides of the die body 26 (the die body 26 having a lateral length L1, whereas the lengths of the slot and heater insert members are shown with similar reference numerals in FIG. 14). The width, height, and length of each slot 28E, 28F, 28G, and 28H may correspond to or depend upon the width, height, and length of a heater insert member 30 configured to be inserted therein (as described above with reference to first die body 22 and FIG. 9, for example). The serpentine groove 38 in each of the heater insert members 30E, 30F, 30G, and 30H can vary based upon the length and/or height of the respective heater insert member. The configuration, placement, and shape of the grooves 38 in each heater insert member 30E, 30F, 30G, and 30H may be dependent upon the configuration, placement, and shape of the die surface the heater insert member 30 associated therewith (e.g., second die surface 28), and/or a position of the heater insert member 30 within the die body.

Although four slots 28E-28H and four heater insert members 30E-30H are shown in this described and illustrative embodiment, the number of slots and/or heater insert members is not intended to be limiting in any way. More or less slots and heater insert members may be provided in a die body. Further, although shown in the illustrative embodiment, the same number of heater insert members need not be provided in the first die body 22 and in the second die body 26. In one embodiment, the first die body 22 has more heater insert members 30 than the second die body 26. In another embodiment, the second die body 26 has more heater insert members 30 than the first die body 22.

Despite the number of heater insert members 30, each heating insert member 30 in the second die body 26 is positioned against an underside of the second die surface 28 to closely position the flexible heater member 36 near the complex die surface. FIG. 14 shows an exemplary view the positioning of the flexible heater 36 in the serpentine groove 38 of the heater insert member 30 when inserted into the second die body 26 and configured for use. Because of the use of the heater insert member(s) 30, at least a portion (e.g., its first portion 44) of the serpentine groove 38 of each heater insert member may be formed to follow the shape of the 3D complex die surfaces of second die surface 28. In an embodiment, at least a portion (e.g., a first portion 44) of the flexible heater member 36 is disposed generally along at least a portion of the periphery of the heater insert member 30 of FIG. 14. The serpentine groove 38 and thus flexible heater member 36 may extend along at least a portion of the periphery of the top, shoulder, side, and transition portions of the heater insert member 30, for example. In an embodiment, the flexible heater member 36 and serpentine groove 38 extend along an entire periphery of the top, shoulder, side and transition portions of the heater insert member 30. The serpentine groove 38 may further include a second portion 46 extending within a central portion of the heater insert member 30 that is inside the periphery of the heater insert member 30. The serpentine groove 38 may include any number of bends or turns within the heater insert member 30. The serpentine groove 38 and flexible heater member 36 may be spaced at a distance D2 that is less than 12 mm from the top and shoulder portion end surfaces, for example, and in some cases, distance D2 is approximately 4 mm. Further, the serpentine groove(s) 38 may be positioned at a distance D that is closer to the die surface 28 and thus provides a more uniform distribution of heat to the respective die surface. The distance D as described above with reference to FIG. 11 may be similar here, and vary as noted.

In the illustrated embodiment of FIG. 14, the heater insert member 30 has a substantially U-shaped configuration, for example, which may include a top portion 68, a pair of transition portions 70, and a pair of shoulder portions 72. The shape of the heater insert member 30 complements the configuration of the die surface 28 of die body 26, which is complimentary to that of the first die body 22. The heater insert member 30 as shown in FIG. 14 also has side portions 74. The top portion 68 and pair of shoulder portions 72 may each have an end surface or edge that are generally parallel to one another, in accordance with an embodiment. The transition portions 70 have end surfaces that connect the top and shoulder portion ends surfaces. The transition portions 70 may be slightly angled relative to the parallel surfaces of the top and shoulder portions 68, 72, for example. The side portions 74 have end surfaces or edges that are perpendicular to the parallel surfaces of the top and shoulder portion end surfaces.

Accordingly, each pair of plates 32 and 34 (of each heater member 30) of FIG. 14 that sandwiches the flexible heater member 36 therebetween may also have a substantially U-shaped configuration, forming one half or side of the U-shape of the heater insert member 30 used, e.g., in the second die body 26. Each plate 32, 34 may include one-half of the top portion 68, transition portions 70, shoulder portions 72, and side portions 74 of the heater insert member 30, thereby forming the substantially U-shaped configuration when assembled and secured together. The groove portions 38A in each plate 32, 34 of the heater member of FIG. 14, and thus the flexible heater 36, may be provided near and around at least the top portion 68, transition portions 70, and shoulder portions 72 of the substantially U-shaped heater member 30, for example.

Also shown in FIG. 13 and FIG. 14 are additional parts associated with the second die body 26 of the second die assembly 14 that are similar to those as described with reference to FIG. 11, e.g., insulators 50, shim plate 52, alignment key(s) 56, cooling paths 62, thermocouplers 64. Thus, for simplicity purposes, some parts of FIG. 13 and FIG. 14 are provided with the same reference numerals and their description is fully not repeated here. The second die body 26 is associated with and placed on a manifold 61 (see also FIG. 12) that is designed to block heat transfer from the die body 26 and heater elements 30 to the rest of the tool or forming system 10. The manifold 61 may include one or more cooling paths 62 therein to assist in cooling the manifold 61. The cooling path(s) 62 may be cooled via fluid (e.g., water), for example.

Also part of the second die body 26 are thermocouples 64, as seen in FIG. 13. As previously noted with reference to die body 22, the thermocouples 64 may be designed to regulate the temperature of the die body 26 to a desired level of temperature (e.g., regulate and control the temperature in the soft zone such that the workpiece 40 is maintain around 550 degrees Celsius). The thermocouples 64 may be positioned in any number of areas within the second die body 26 and are not limited to the illustrated location of FIG. 13. A location and number of thermocouples provided in the die body 26 may be based on a desired heating distribution set by a customer, for example.

The flexible tubular heater members 36 and heating element 30 as disclosed herein can more evenly cover an entire complex 3D surface of each die and accordingly provide a more even distribution of heat to part of a workpiece. The flexible heater members 36 can also maintain consistent distance from heaters and 3D surfaces.

The flexible heater members 36 can be applied to most all kinds of surfaces with high efficiency, whether they are simple and complex, since only a moderate quality of machining of a die or stamp part is required to form the groove. The flexible heater members 36 are easy to install with a simple tool (e.g., hammer or mallet) and require no high assembly skill. Further, there are little to no seizing issues and/or breakage issues, and no special cleaning procedure needed is required for heater replacement.

In one embodiment, the first die body 22 and the second die body 26 may include cooling channel(s) 31 or structure(s) formed within the form body of the respective die body to regulate the amount of heat to the soft zone of the workpiece 40 and to control the temperature of the respective die body. Cooling channel(s) 31 may be provided adjacent to the heater insert members 30 of the die bodies 22 and 26. For example, referring to FIG. 5 and FIG. 15, a cooling channel 31 may be constructed and arranged to be part of each slot 28A, 28B, etc. that receives the heater insert member 30 therein, i.e., channel 31 is formed between an edge of the slot 28A, 28B, etc. and an edge of heater insert member 30 when the heater insert member 30 is inserted into the slot 28A, 28B, etc. For example, as previously noted with respect to FIG. 11, in one embodiment, the length L3 of a slot is greater than the length L2 of the heater insert member 30. The heater insert member 30 may be sized such that once inserted into a respective slot, a space or channel 31 is formed between an end of the heater insert member 30 and an end of the slot 28A, 28B, etc. The size of the space may then be defined as L3-L2 (length of the slot minus length of the heater insert member). The space 31 thus may form a cooling channel that is used to carry a cooling fluid therein. In accordance with one embodiment, the fluid carried by the cooling channel(s) 31 is air. The air may be delivered to the channel(s) 31 from a cooling system 18 (or a part of the system) via manifold 60 and/or 61, for example.

Figure 15:
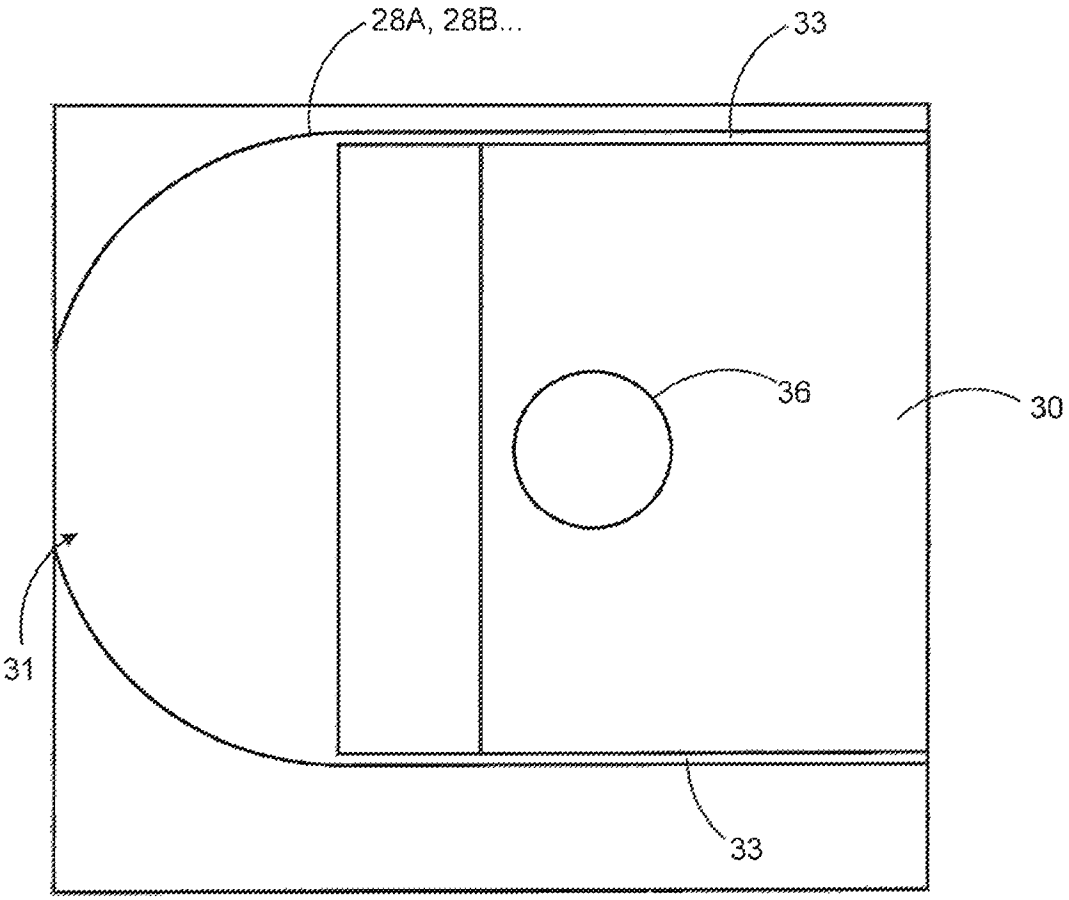
FIG. 15 is a detailed view of an exemplary cooling channel provided adjacent to each heater insert member in the lower die body or the upper die body, as noted in FIG. 5, for example.

Moreover, in an embodiment, a space 33 may be provided on either side of the heater member 30 between an outer side of the heater insert member 30 and an inner side of the slot 28A, 28B, etc., as shown in FIG. 15. In an embodiment, the space is between approximately 0.1 mm and 1.0 mm. In one embodiment, the space is approximately 0.3 mm.

Die parts 21, 23, and 25 of the first die assembly 12 and the corresponding die parts of the second die assembly 14 to die parts 21, 23, and 25 may include quenching channels therein that are cooling channels for carrying a cooling fluid therein and designed to quench specific parts of the workpiece 40. In one embodiment, the cooling fluid used to quench the adjacent die parts 21, 23, and 25 is a liquid. As such, the first die assembly 12 and the second die assembly 14 may be operatively coupled to the cooling system 18 (or part of the system) such that the first die assembly 12 and the second die assembly 14 are configured to cool portions of the die—and thus the workpiece 40—when die cavity is closed. For example, the first die body 22 and the second die body 26 are operatively coupled to the cooling system 18 (see FIGS. 1A and 1B). The cooling system 18 may include a source of cooling fluid. In one embodiment, cooling fluid may include air, water, oil, saline, gas or other fluid medium. In an embodiment, multiple sources of fluid—e.g., air and water—may be controlled and provided by the cooling system 18. Cooling fluid, provided by the cooling system 18, may be continuously circulated through cooling channels or structures to cool the die assemblies 12 and 14. In one embodiment, the cooling system 18 may include a reservoir/chiller. In one embodiment, the cooling system 18 may include a pressure source or a fluid pump for forcing the cooling fluid through the cooling channels or structures. In one embodiment, the cooling fluid may be cycled in a continuous, uninterrupted manner, but it will be appreciated that the flow of cooling fluid may be controlled in a desired manner to further control the cooling of the die surfaces. It may be appreciated that circulating cooling fluids cools the die assemblies 12 and 14, and that the cooled die assemblies 12 and 14, in turn, may quench and cool portions of the hot formed member, while still regulating temperature and heat for a specific portion of the workpiece (e.g., a portion that is adjacent dies 22 and 26).

While the present disclosure can be used for forming automobile body pillars and/or panels, the same system and method can be used to form sheets and/or workpieces into desired shapes that can be used for other applications.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the scope of the following claims.

What is claimed is:

1. A forming system comprising:

a first die assembly having a first die body and a first die surface;

a second die assembly having a second die body and a second die surface;

the first die surface and the second die surface having varying cross sections and configured to cooperate with each other to form a die cavity therebetween so as to receive a workpiece therein, a first heater insert member configured to be inserted and received within one of the first die body and the second die body, the first heater insert member having a first serpentine groove therein, and a first flexible heater member, the first flexible heater member being disposed in the first serpentine groove and configured to conform with the shape of the first serpentine groove, wherein the first heater insert member comprises a pair of plates, and wherein the pair of plates each has a groove portion forming the first serpentine groove, and wherein the first flexible heater member is disposed between the plates within the first serpentine groove.

2. The forming system according to claim 1, further comprising:

a second heater insert member configured to be received in the other one of the first die body and the second die body, the second heater insert member having a second serpentine groove therein, and a second flexible heater member, the second flexible heater member being disposed in the second serpentine groove and configured to conform with the shape of the second serpentine groove.

3. The forming system according to claim 1, wherein the first serpentine groove has a first portion and a second portion, the first portion disposed generally along the periphery of the first heater insert member and the second portion extending within a central portion of the first heater insert member that is inside the periphery of the first heater insert member.

4. The forming system according to claim 1, wherein the one of the first die body and the second die body comprises a slot for receipt of the first heater insert member therein.

5. The forming system according to claim 4, wherein a cooling channel is formed in a gap between the first heater insert member and an end of the slot to circulate cooling fluid therein and cool the respective die assembly.

6. The forming system according to claim 1, wherein either the first die assembly or the second die assembly, or both, further comprises a cooling channel to circulate cooling fluid therein and cool the respective die assembly.

7. The forming system according to claim 1, wherein the first and second die surfaces have three-dimensional surface configurations.

8. The forming system according to claim 1, wherein the one of the first die body and the second die body comprises a plurality of the first heater insert members received therein.

9. The forming system according to claim 2, wherein the one of the first die body and the second die body comprises a plurality of the first heater insert members received therein, and wherein the other one of the first die body and the second die body comprises a plurality of the second heater insert members disposed therein.

10. The forming system according to claim 1, wherein a minimum distance between the die surface of the one of the first die body and the second die body and the first serpentine groove is 10 mm to 35 mm.

11. A method of forming a sheet metal member in a forming system, the forming system comprising a first die assembly having a first die surface and a second die assembly having a second die surface, wherein the first die surface and the second die surface have three dimensional surface configurations and are configured to cooperate with each other to form a die cavity therebetween so as to receive a workpiece therein, a first heater insert member configured to be inserted and received within the first die assembly, the first heater insert member having a first serpentine groove therein and a first flexible heater member disposed in the first serpentine groove and configured to conform with the shape of the first serpentine groove, wherein the first heater insert member comprises a pair of plates, and wherein the pair of plates each has a groove portion forming the first serpentine groove, and wherein the first flexible heater member is disposed between the plates within the first serpentine groove; the method comprising:

moving the first die assembly relative to the second die assembly along a first axis to move the die cavity from an open position to a closed position, heating the first flexible heater member using a heat source, to thereby heat the first heater insert member, and wherein heating the first flexible heater member transfers heat to the first die surface during forming of the sheet metal member.

12. The method according to claim 11, wherein the forming system further comprises a second heater insert member configured to be received in the second die assembly, the second heater insert member having a second serpentine groove therein and a second flexible heater member disposed in the second serpentine groove and configured to conform with the shape of the second serpentine groove; the method further comprising:

heating the second flexible heater member using the heat source, to thereby heat the second heater insert member, and wherein heating the second flexible heater member transfers heat to the second die surface during forming of the sheet metal member.

13. A forming system for forming a pillar of an automobile comprising:

a first die assembly having a first die body and a first die surface;

a second die assembly having a second die body and a second die surface;

the first die surface and the second die surface having varying cross sections and configured to cooperate with each other to form a die cavity therebetween so as to receive a workpiece therein, a first heater insert member configured to be inserted and received within one of the first die body and the second die body, the first heater insert member having a first serpentine groove therein, and a first flexible heater member, the first flexible heater member being disposed in the first serpentine groove and configured to conform with the shape of the first serpentine groove, wherein the first heater insert member has a top hat shaped configuration including a top portion, a pair of shoulder portions, and a pair of transition portions and wherein the first flexible heater member and first serpentine groove extend along at least a portion of the periphery of the top, shoulder, and transition portions of the first heater insert member, wherein the first heater insert member comprises a pair of plates, and wherein the pair of plates each has a groove portion forming the first serpentine groove, and wherein the first flexible heater member is disposed between the plates within the first serpentine groove.

14. The forming system according to claim 13, further comprising:

a second heater insert member configured to be received in the other one of the first die body and the second die body, the second heater insert member having a second serpentine groove therein, and a second flexible heater member, the second flexible heater member being disposed in the second serpentine groove and configured to conform with the shape of the second serpentine groove.

15. The forming system according to claim 13, wherein the first flexible heater member and first serpentine groove extend along an entire periphery of the top, shoulder, and transition portions of the first heater insert member.

16. The forming system according to claim 13, wherein the first serpentine groove is spaced less than 12 mm from the top and shoulder portion end surfaces of the first heater insert member.

17. The forming system according to claim 13, wherein the first flexible heater member is spaced less than 35 mm from the respective die surface.

18. The forming system according to claim 13, wherein the one of the first die body and the second die body comprises a first slot for receipt of the first heater insert member therein.

19. The forming system according to claim 18, wherein a cooling channel is formed in a gap between the first heater insert member and an end of the first slot to circulate cooling fluid therein and cool the respective die assembly.

20. The forming system according to claim 13, wherein either the first die assembly or the second die assembly, or both, further comprises a cooling channel to circulate cooling fluid therein and cool the respective die assembly.

21. The forming system according to claim 13, wherein the first and second die surfaces have three-dimensional surface configurations.

22. The forming system according to claim 13, wherein the one of the first die body and the second die body comprises a plurality of the first heater insert members received therein.

23. The forming system according to claim 14, wherein the one of the first die body and the second die body comprises a plurality of the first heater insert members received therein, and wherein the other one of the first die body and the second die body comprises a plurality of the second heater insert members received therein.

24. The forming system according to claim 13, wherein a minimum distance between the die surface of the one of the first die body and the second die body and the first serpentine groove is 10 mm to 35 mm.

* * * * *